US006488124B1

(12) United States Patent
Yasuda et al.

(10) Patent No.: US 6,488,124 B1
(45) Date of Patent: Dec. 3, 2002

(54) ELEVATOR

(75) Inventors: Kunio Yasuda, Tokorozawa (JP); Yoshiaki Fujita, Tokyo (JP); Kosei Kamimura, Tokyo (JP); Ikuo Asami, Wako (JP); Yasuyuki Wagatsuma, Kawaguchi (JP); Kiyoshi Kobayashi, Tokyo (JP); Tadashi Munakata, Tokyo (JP); Shin Murakami, Tokyo (JP); Yoshinobu Ishikawa, Tokyo (JP); Takeshi Miyata, Tokyo (JP); Mitsuo Hayase, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/160,596

(22) Filed: Sep. 25, 1998

(30) Foreign Application Priority Data

| | | |
|---|---|---|
| Sep. 26, 1997 | (JP) | 9-261175 |
| Oct. 6, 1997 | (JP) | 9-272283 |
| Nov. 4, 1997 | (JP) | 9-301738 |
| Nov. 5, 1997 | (JP) | 9-302375 |

(51) Int. Cl.[7] ..... B66B 11/08; B66B 7/06

(52) U.S. Cl. ..... 187/254; 187/251; 187/256

(58) Field of Search ..... 187/250, 254, 187/256, 257, 258, 260, 404, 411, 407, 249, 263, 264, 265, 266

(56) References Cited

U.S. PATENT DOCUMENTS

| | | | | | |
|---|---|---|---|---|---|
| 78,829 | A | * | 6/1868 | Reedy | 187/266 X |
| 282,703 | A | * | 8/1883 | Collins | 187/404 X |
| 485,163 | A | * | 11/1892 | Bassett | 187/260 |
| 1,023,124 | A | * | 4/1912 | Clark | 187/251 X |
| 1,763,198 | A | * | 6/1930 | Sprague | 187/404 X |
| 1,837,643 | A | * | 12/1931 | Anderson | 187/257 X |
| 1,888,612 | A | * | 11/1932 | Anderson | 187/260 X |
| 1,896,776 | A | * | 2/1933 | James | 187/404 X |
| 1,911,834 | A | * | 5/1933 | Lindquist | 187/404 X |
| 2,522,614 | A | * | 9/1950 | Helling | 187/260 |
| 4,226,404 | A | * | 10/1980 | Zens | 187/404 X |
| 5,226,507 | A | | 7/1993 | Kawarasaki et al. | |
| 5,899,301 | A | * | 5/1999 | Aulanko et al. | 187/266 |

FOREIGN PATENT DOCUMENTS

| | | | | |
|---|---|---|---|---|
| DE | 1 000 138 | | 1/1957 | |
| DE | 1 032 496 | | 6/1958 | |
| DE | 197 12 646 | | 10/1998 | |
| EP | 0 385 277 | | 5/1990 | |
| EP | 0 170 618 | | 5/1996 | |
| EP | 0 745 553 | | 12/1996 | |
| EP | 0 784 030 | | 7/1997 | |
| FR | 2 087 061 | | 12/1971 | |
| GB | 616357 | | 1/1949 | |
| JP | 2-233492 | | 9/1990 | |
| JP | 4-50297 | | 11/1992 | |
| JP | 7-117957 | A * | 5/1995 | B66B/11/08 |
| JP | 8-175623 | A * | 7/1996 | B66B/11/08 |
| JP | 2593288 | | 12/1996 | |

* cited by examiner

*Primary Examiner*—Eileen D. Lillis
*Assistant Examiner*—Thuy V. Tran
(74) *Attorney, Agent, or Firm*—Oblon, Spivak, McClelland, Maier & Neustadt, P.C.

(57) ABSTRACT

In an elevator, a driving unit is installed at the top of an elevator shaft above a counterweight. Traction sheaves engage with ropes and are rotated by the driving device. These traction sheaves are positioned close to wall surfaces of the elevator shaft, that are adjacent to its wall surface facing the counterweight. The traction sheaves are also positioned outside the horizontally projected plane of a car.

18 Claims, 27 Drawing Sheets

ELEVATOR

BACKGROUND OF THE INVENTION

The present invention relates to a traction elevator which obviates the need for a machine house for installing a driving device.

Recently, to eliminate the need for a rope elevator machine house installed at the top of the elevator shaft in relation to a right to enjoy sunshine, various elevators such as a linear motor elevator and an elevator whose hoisting device is installed in the gap between the elevator car and the elevator shaft wall have been proposed.

FIG. 1 shows an outline of an elevator, such as described in Jpn. Pat. Appln. KOKAI Publication No. 2-23492, in which the armature of a cylindrical linear motor 51 is built into a counterweight 50. A car 52 is moved up and down via a rope by the driving mechanism of the elevator, which is built into the counterweight 50. This eliminates the need for a machine house in a conventional rope elevator.

The linear motor elevator shown in FIG. 1 has the advantage of making a conventional machine house unnecessary. However, an overhead sheave for suspending a car must be installed above the car in the elevator shaft. This increases the height of the elevator shaft itself, so the elevator shaft protrudes from the roof of the building. This makes the elevator not satisfactorily effective. Additionally, since the driving device is attached to the counterweight, the plane size of the counterweight increases, and this increases the plane size of the elevator shaft. Consequently, the effective use area of the building decreases.

FIGS. 2, 3A, and 3B show outlines of elevators, such as described in Jpn. UM Appln. KOKOKU Publication No. 4-50297 and Japanese Pat. No. 2593288, in which a hoisting device 53 is installed in the gap between the elevator shaft wall and a side surface of a car 55 at the top of an elevator shaft 54.

In the elevator disclosed in Jpn. UM Appln. KOKOKU Publication No. 4-50297, as shown in FIG. 2, a motor is used as the driving device 53, and the car 55 and a counterweight 56 are suspended like well buckets. A traction sheave 57 is placed in the upper portion of the elevator shaft 54. The car 55 is attached to one end of a rope 58 wound around the traction sheave 57, and the counterweight 56 is attached to the other end of the rope 58. The traction sheave 57 is driven by the motor, and the driving force is transmitted to the rope 58 by the friction between the rope 58 and the traction sheave 57, thereby vertically moving the car 55 and the counterweight 56. In this structure, the driving device 53 is large. Therefore, a conventional machine house is eliminated by increasing the size of the elevator shaft 54, and the driving device 53 is installed in an empty space of the elevator shaft 54.

In the driving device support structure shown in FIG. 2 in which the driving device is installed in the gap between the elevator shaft wall and the car, the rotating surface of the traction sheave 57 is perpendicular to the side surface of the car. Accordingly, the gap between the car and the wall must be larger than that in common elevators. This decreases the effective use area of the building.

The principle of operation of the elevator disclosed in Japanese Patent No. 2593288 shown in FIGS. 3A and 3B is basically the same as the elevator shown in FIG. 2. A motor is used as a driving device 53, and a car 55 and a counterweight 56 are suspended like well buckets. A traction sheave 57 is placed in the upper portion of an elevator shaft 54. The car 55 is attached to one end of a rope 58 wound around the traction sheave 57, and the counterweight 56 is attached to the other end of the rope 58. The traction sheave 57 is driven by the motor, and the driving force is transmitted to the rope 58 by the friction between the rope 58 and the traction sheave 57, thereby vertically moving the car 55 and the counterweight 56. In this structure, however, as a method of installing the driving device 53 in an empty space of the elevator shaft 54, the driving device 53 is attached to counterweight guide rails 59*a* and 59*b* via fixing members. Also, to install the driving device 53 in an empty space of the elevator shaft 54, the rope 58 is extended via deflection pulleys 60*a* to 60*c*. With this arrangement, a conventional machine house is unnecessary.

In the structure shown in FIGS. 3A and 3B, if the rated loadage of the car increases, the thickness of the traction sheave 57 increases to make the traction sheave 57 unable to install in the gap between the car and the elevator shaft wall. Additionally, since the driving device is supported by the guide rails, the load on the guide rails increases. Then, the size of the elevator cannot be increased. Also, since the return sheave is mounted on the car, the driving device support structure is complicated, and the number of parts of the structure increases. This increases the cost and makes the installation maintenance troublesome.

BRIEF SUMMARY OF THE INVENTION

Accordingly, it is an object of the present invention to provide a machine-houseless traction elevator by which the plane size and height of an elevator shaft can be decreased.

It is another object of the present invention to provide a machine-houseless traction sheave elevator by which the size of an elevator shaft is equivalent to that in a conventional elevator with a machine house and a driving device can be mounted without forming any projecting portion on the roof of a building, and which has a mounting structure for firmly supporting the driving device.

According to one aspect of the present invention, there is provided an elevator comprising: a car moving up and down along car guide rails; a counterweight moving up and down along counterweight guide rails; ropes for suspending the car and the counterweight; a driving device installed at a top of an elevator shaft above the counterweight; and at least one traction sheave engaging with the rope and rotated by the driving device, the traction sheave being placed close to a wall surface of an elevator shaft wall, which is adjacent to a wall surface facing the counterweight and outside a horizontally projected plane of the car.

According to another aspect of the present invention, there is provided an elevator comprising: a car moving up and down along car guide rails; a counterweight moving up and down along counterweight guide rails; ropes for suspending the car and the counterweight; and a driving device comprising traction sheaves engaging with the ropes, the driving device being installed in an upper portion of an elevator shaft, and the traction sheaves being attached to two ends of an output shaft of the driving device.

According to still another aspect of the present invention, there is provided an elevator comprising: a car moving up and down along car guide rails;

a counterweight installed close to a side surface of the car and moving up and down along counterweight guide rails; ropes for suspending the car and the counterweight like well buckets; a driving device installed at a top of an elevator shaft above the counterweight; and at least one traction sheave attached to an end portion of the driving device and engaging with and driving the rope, the traction sheave being positioned close to a wall surface of an elevator shaft wall, which is adjacent to a wall surface facing the counterweight, and outside a horizontally projected plane of the car.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; a driving device for driving the traction sheaves attached to two ends of the driving device; and support beams for integrally connecting the car guide rails with the counterweight guide rails, the driving device being mounted on the support beams.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; a driving device for driving the traction sheaves attached to two ends of the driving device; support beams for integrally connecting the car guide rails with the counterweight guide rails; and a plurality of mounting legs placed on the support beams to fix the driving device, the mounting legs being formed on a lower surface and a side surface of the driving device.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; a driving device for driving the traction sheaves attached to two ends of the driving device; and fixing plates placed on upper end faces of the car guide rails or the counterweight guide rails, the driving device being mounted on the fixing plates.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; a driving device for driving the traction sheaves attached to two ends of the driving device; and support members for fixing the driving device to the car guide rails or the counterweight guide rails, the support members comprising horizontal support members placed on upper end faces of the car guide rails or the counterweight guide rails and front support members extending downward parallel to the guide rails to fix the driving device.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; a driving device for driving the traction sheaves attached to two ends of the driving device; and a support member attached to an elevator shaft wall at a top of an elevator shaft, the driving device being mounted on the support member.

According to still another aspect of the present invention, there is provided an elevator comprising: a car moving up and down along a pair of car guide rails; a counterweight moving up and down along a pair of counterweight guide rails; a plurality of ropes for suspending the counterweight; traction sheaves engaging with the ropes; and a driving device for driving the traction sheaves attached to two ends of the driving device, the driving device being mounted on an elevator shaft wall at a top of an elevator shaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention in which.

DETAILED DESCRIPTION OF THE INVENTION

Figure 1:
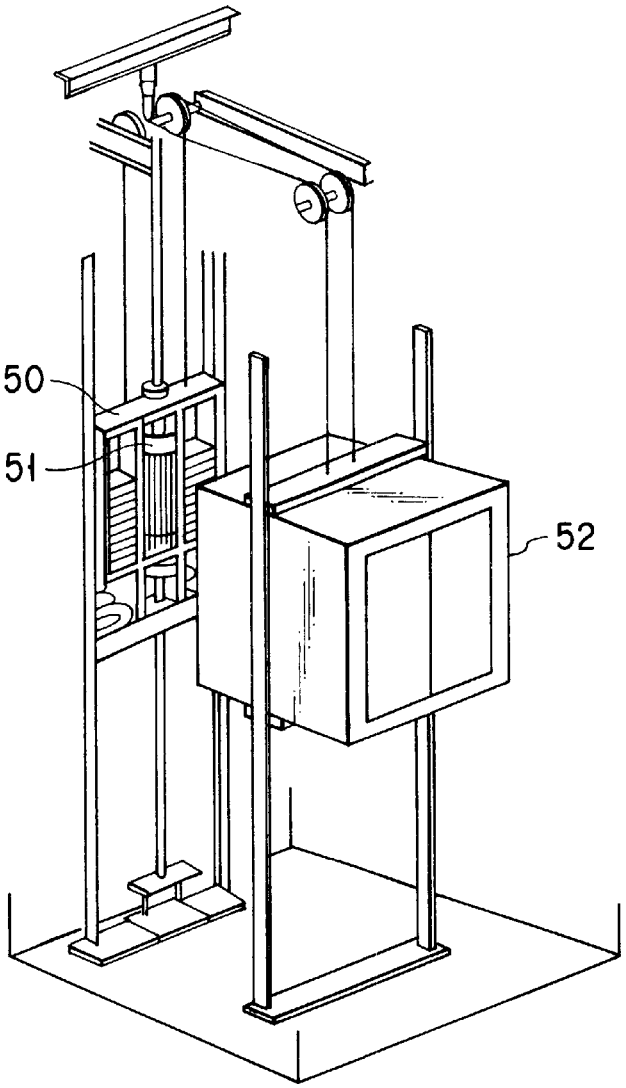
FIG. 1 (PRIOR ART)
FIG. 1 is a view showing an outline of a conventional well bucket type linear motor elevator.
Figure 2:
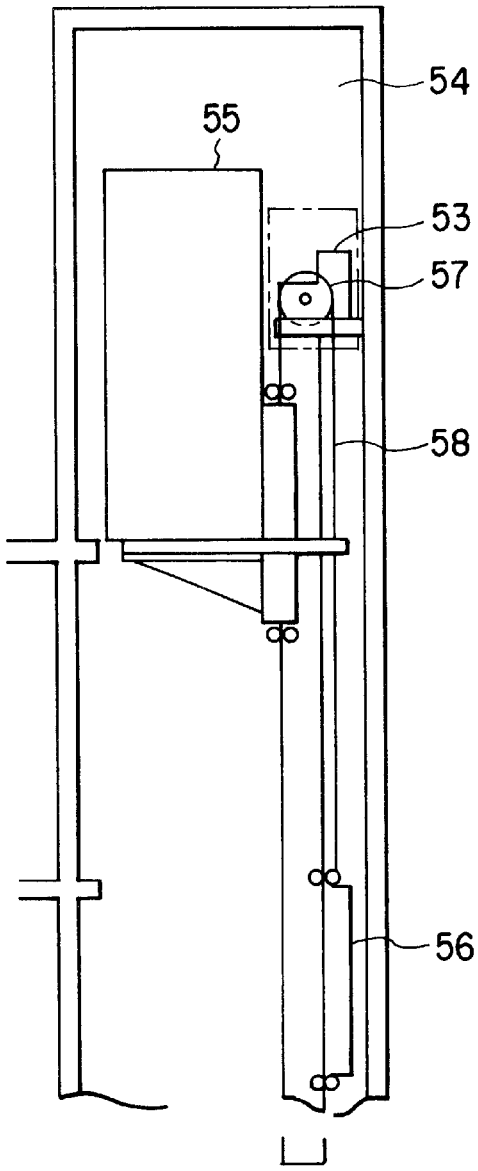
FIG. 2 (PRIOR ART)
FIG. 2 is a view showing the arrangement of a conventional machine-houseless elevator.
Figure 3A:
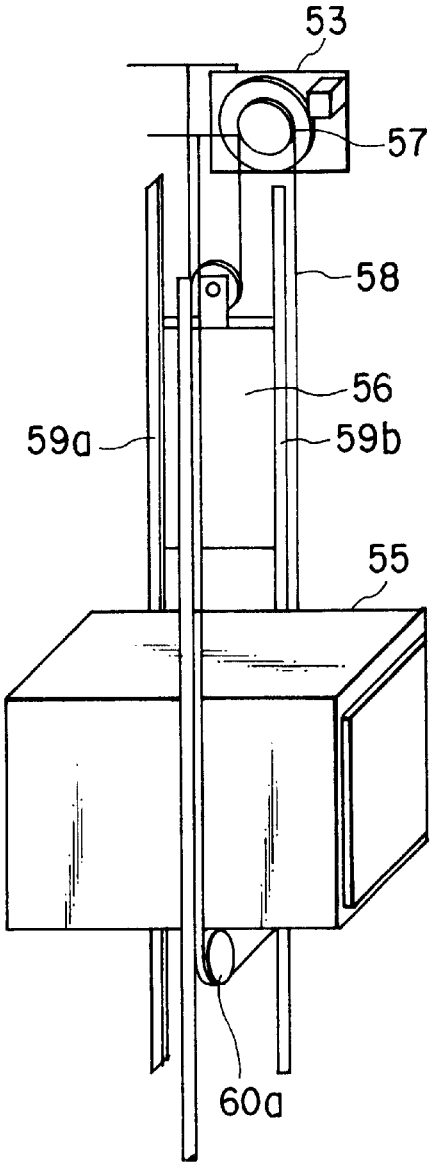
FIG. 3A (PRIOR ART)
FIGS. 3A and 3B are views showing the arrangement of a conventional machine-houseless elevator.
Figure 3B:
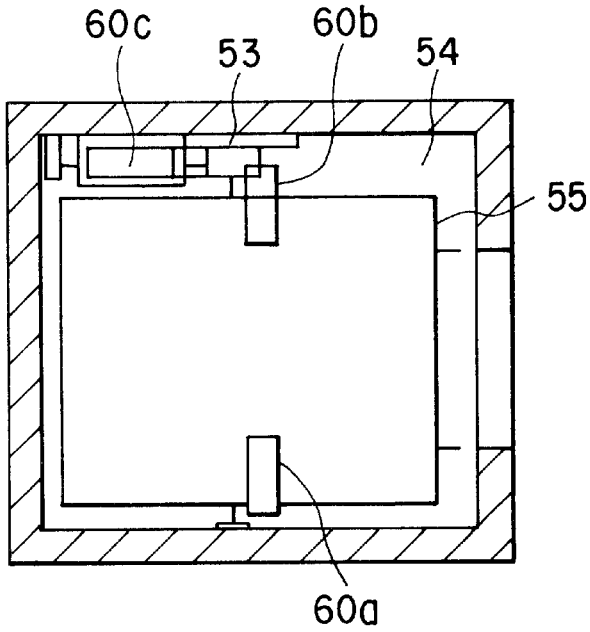
FIG. 3B (PRIOR ART)
Figure 4:
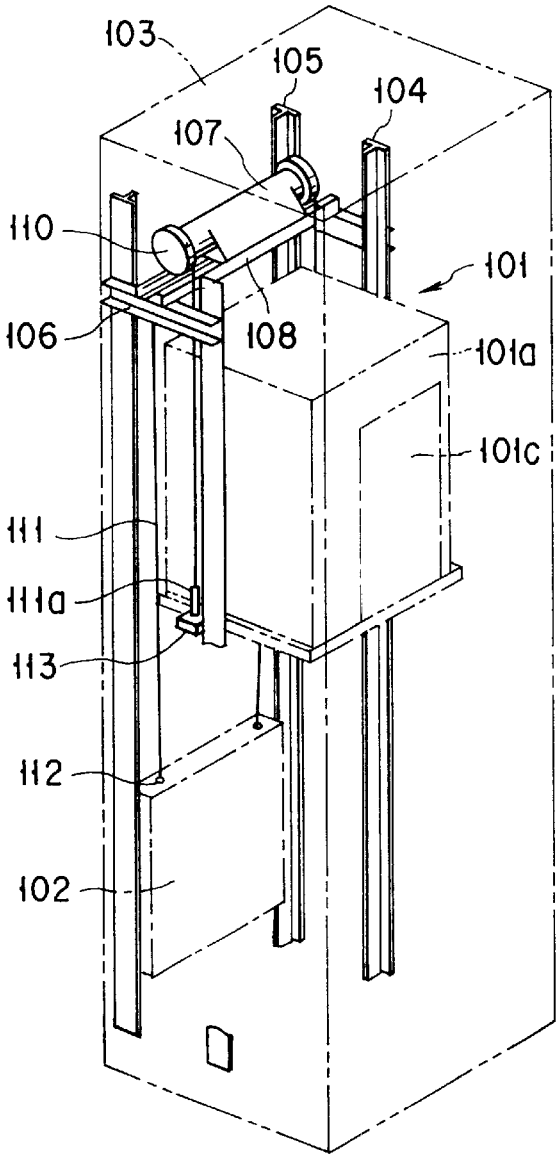
FIG. 4 is a view of the overall arrangement of an elevator according to the first embodiment of the present invention.

Embodiments of the present invention will be described in detail below with reference to the accompanying drawings.

[First Embodiment]

FIGS. 4 to 7 show an outline of an elevator according to the first embodiment of the present invention. In the elevator of this embodiment, a pair of car guide rails 104 and a pair of counterweight guide rails 105 for guiding a car 101 and a counterweight 102, respectively, are installed in an elevator shaft 103 in which the car 101 and the counterweight 102 go up and down.

The car 101 includes a car room 101*a* for accommodating passengers, a car frame 101*b* for supporting the car room 101*a,* and a doorway 101*c*.

A pair of connecting beams 106 extend across the tops of the car guide rails 104 and the counterweight guide rails 105. A support beam 108 for mounting a driving device 107 extends across the connecting beams 106.

Figure 7:
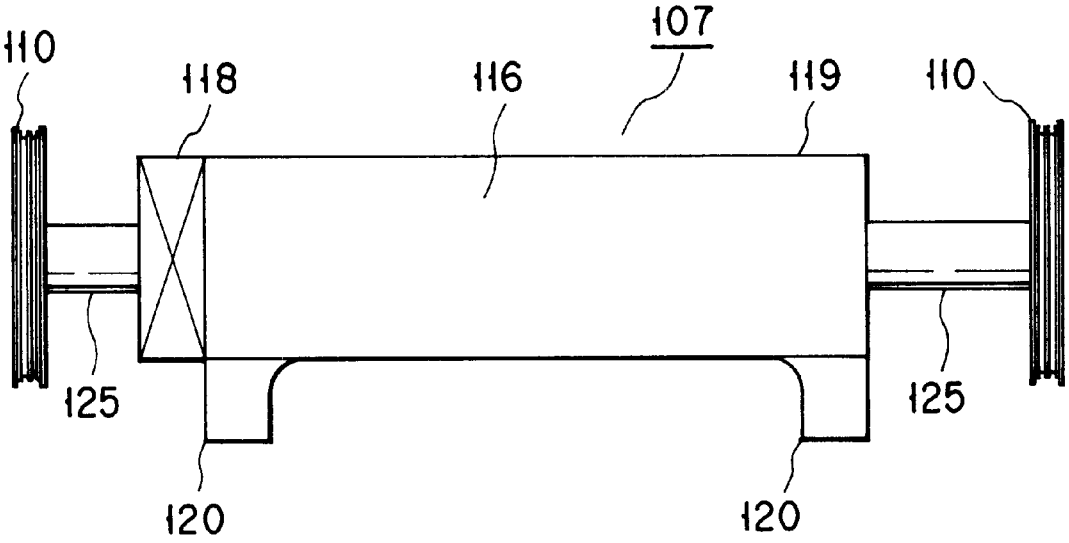
FIG. 7 is a plan view showing the arrangement of a driving device of the elevator according to the first embodiment of the present invention.

As shown in FIG. 7, the driving device 107 mounted on the support beam 108 is a gearless driving device having no speed reducer. This driving device 107 includes a hoisting device (hoisting motor) 116, a brake 118, a frame 119 for supporting the hosting device and the brake, and support legs 120 for fixing the driving device to the support beam 108. Driving traction sheaves 110 are attached to output shafts 125 at the two ends of the hoisting device. Note that this traction sheave 110 can also be attached only to one end of the driving device 107.

Ropes 111 are wound around these traction sheaves 110 like well buckets. One end of each rope 111 is connected to a rope hitch 112 in the upper portion of the counterweight 102. The other end of each rope 111 is attached to a hitch 113 formed on the car frame 101*b* in the lower portion of the car 101 via a shackle rod 111*a*. Two such hitches 113 are formed in substantially symmetrical positions in the rear (on the counterweight 102 side) of the car 101 when viewed from the doorway 101*c*. Note that only one hitch is necessary if the traction sheave 110 is attached only to one end of the driving device 107.

The counterweight 102 is placed at the back of the car 101 when viewed from the doorway 101*c*. The driving device 107 is positioned at the top of the elevator shaft 103 along the vertical extension line of the counterweight 102.

Figure 5:
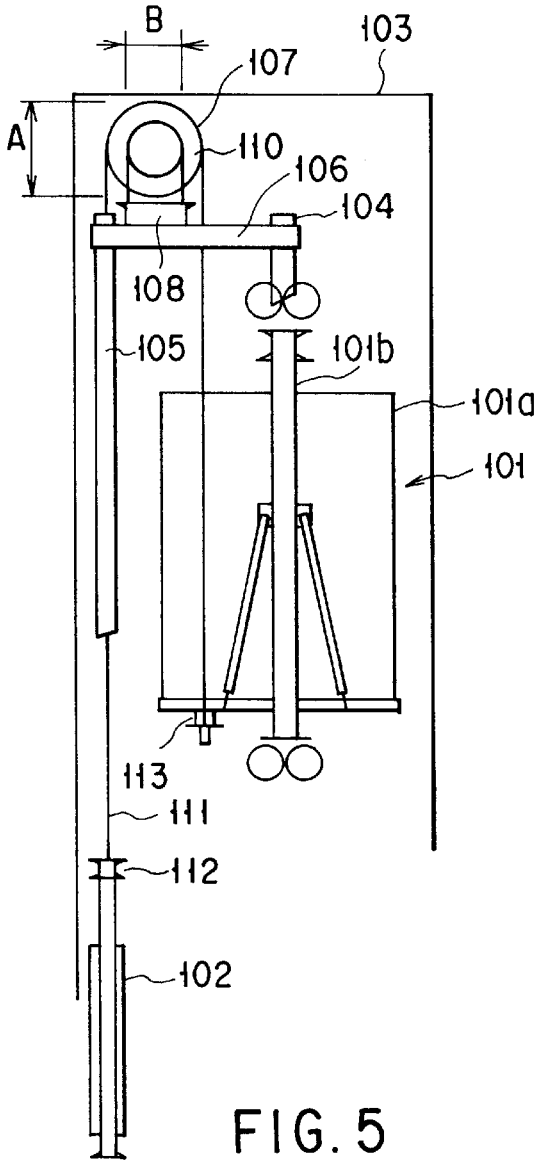
FIG. 5 is a plan view of the elevator according to the first embodiment of the present invention.
Figure 6:
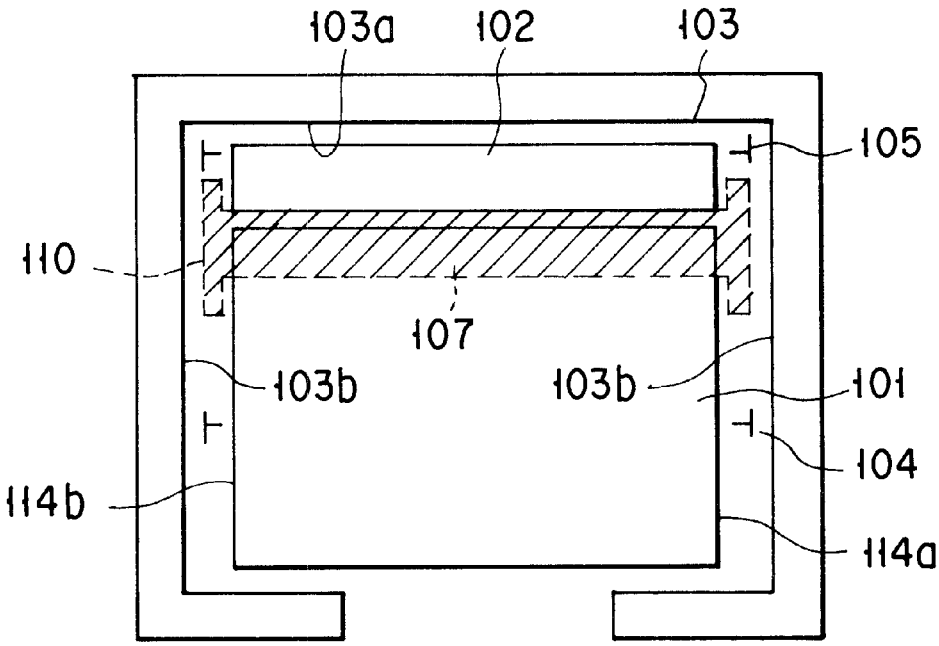
FIG. 6 is a horizontal sectional view of the elevator according to the first embodiment of the present invention.

FIG. 6 is a horizontal sectional view of the elevator of the first embodiment. As shown in FIG. 6, the driving device 107 is long in the widthwise direction when viewed from the doorway. The traction sheaves 110 attached to the two ends of the hoisting device of the driving device 107 are placed near wall surfaces 103*b* of the elevator shaft 103, which are adjacent to a wall surface 103*a* facing the counterweight 102. More specifically, the traction sheaves 110 are positioned between side surfaces 114*a* and 114*b* (adjacent to the surface of the car which opposes the counterweight 102) of the car 101 and the adjacent wall surfaces 103*b* of the elevator shaft 103 and outside the horizontally projected plane of the car. Also, as shown in FIG. 5, an outside diameter B (outside diameter of the hoisting motor) of the frame 119 of the driving device 107 is made smaller than a diameter A of the traction sheaves 110.

The operation of the elevator according to the first embodiment with the above arrangement will be described below.

When the hoisting device of the driving device 107 is driven, the traction sheaves 110 connected directly with the two ends of the hoisting device rotate, and the ropes 111 are driven by the static frictional force (traction) between the traction sheaves 110 and the ropes 111. Consequently, the car 101 and the counterweight 102 connected to the ropes 111 move up and down along the guide rails 104 and 105, respectively.

In the above elevator of the first embodiment, the traction sheaves 110 attached to the two ends of the hoisting device of the driving device 107 are placed near the adjacent wall surfaces 103*b* so as to be positioned between the side surfaces 114*a* and 114*b* of the car 101 and the elevator shaft walls and outside the horizontally projected plane of the car. Therefore, even when the car 101 ascends to the vicinity of the top of the elevator shaft, the traction sheaves 110 do not interfere with the car 101. Consequently, the dimension of the driving device 107 at the top of the elevator shaft can be decreased. Additionally, the horizontal sectional size of the elevator shaft can be decreased.

Also, the counterweight 102 is installed at the back of the car 101 when viewed from the doorway. Accordingly, even when the dimension of the elevator shaft in the widthwise direction of the doorway cannot be increased, the elevator can be installed without increasing the elevator shaft size.

Furthermore, the traction sheaves 110 are attached to the two ends of the hoisting device of the driving device 107. This increases the degree of freedom of the positions where the car 101 is suspended. Consequently, the car 101 can be stably moved up and down.

Additionally, the use of the hoisting motor having a smaller diameter than the diameter of the traction sheaves 110 decreases the dimension of the driving device 107 at the top of the elevator shaft.

Also, the driving device 107 does not use any speed reducer, so silent and good running characteristics can be obtained.

The hitches 113 of the car frame 101*b* are formed in the lower portion of the car 101. Therefore, the height of the elevator shaft can be decreased, and the structure of the car frame 101*b* can be simplified and made light in weight.

Also, the hitches 113 are formed in substantially symmetrical positions of the car 101 when viewed from the doorway 1O*c*. Accordingly, well-balanced good running characteristics can be obtained.

[Second Embodiment]

Figure 8:
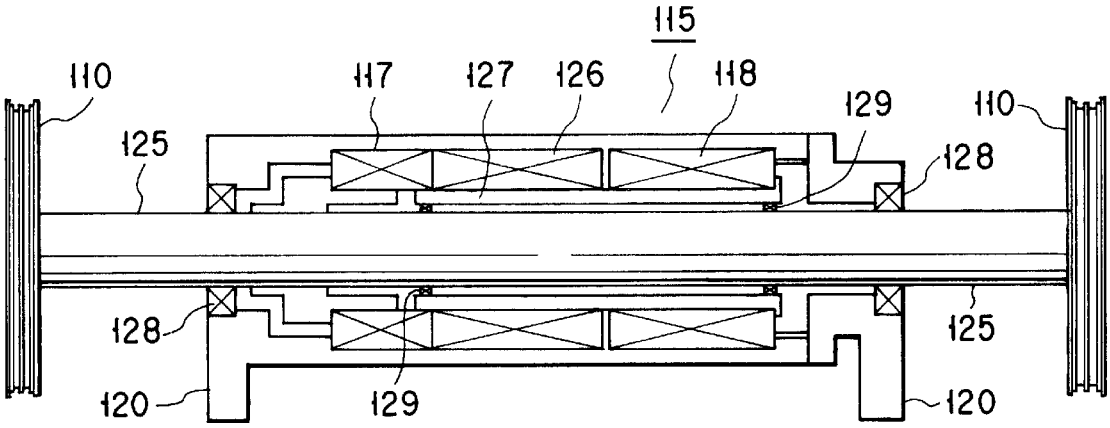
FIG. 8 is a plan view showing the arrangement of a driving device of an elevator according to the second embodiment of the present invention.

FIG. 8 shows the arrangement of a driving device of an elevator according to the second embodiment of the present invention. The arrangement except for this driving device is similar to that of the first embodiment.

In a driving device 115 of the elevator of this second embodiment, a hollow output shaft 127 of a driving motor 126 horizontally extends and is supported by bearings 129. A hollow speed reducer 117 and a brake 118 for braking the rotation of the motor 126 are attached coaxially with the hollow output shaft 127 of the driving motor 126. An output shaft 125 is attached to the output side of the hollow speed reducer 117 via bearings 128. Traction sheaves 110 are attached to the two ends of the output shaft 125. Ropes 111 for suspending a car 101 and a counterweight 102 (neither are shown) are wound around the traction sheaves 110.

The operation of this embodiment will be described below. The driving motor 126 rotates and inputs power to the hollow speed reducer 117 connected directly with the hollow output shaft 127, thereby transmitting the rotational speed and driving force necessary to vertically move the car 101 to the output shaft 125 attached to the output side of the hollow speed reducer 117. The car 101 goes up and down via the traction sheaves 110 attached to the output shaft 125 and the ropes 111.

In addition to the effects of the first embodiment, in this embodiment the driving motor 126, the speed reducer 117, and the brake 118 each having a hollow structure can be placed coaxially with the output shaft 125. This makes the driving device 115 small in size and light in weight. Additionally, since the output shaft 125 is driven via the speed reducer 117, various capacities and speeds required of the elevator can be controlled by simple changes, i.e., by changing the speed reducing ratio of the speed reducer 117 and the capacity of the driving motor 126.

Figure 9:
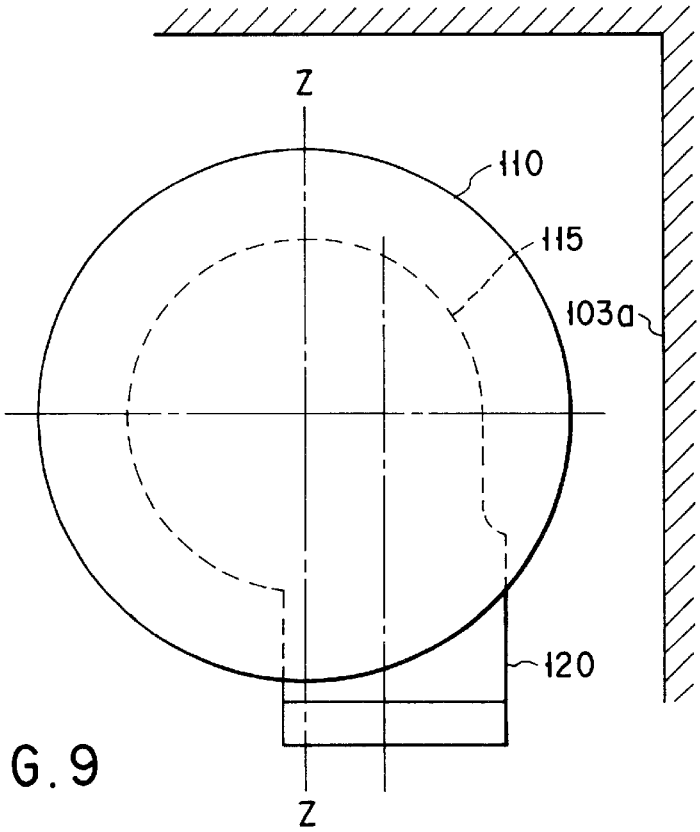
FIG. 9 is a side view showing the arrangement of the driving device of the elevator according to the second embodiment of the present invention.

Also, as shown in FIG. 9, support legs 120 are offset from a plane Z connecting the vertical central lines of the traction sheaves 110 toward an opposing wall surface 103*a*, i.e., in the direction away from the car 101. Therefore, the elevation stroke of the car 101 can be increased without changing the height of the elevator shaft. The same effect can be obtained by applying these support legs 120 to the driving device 107 of the first embodiment.

Figure 10:
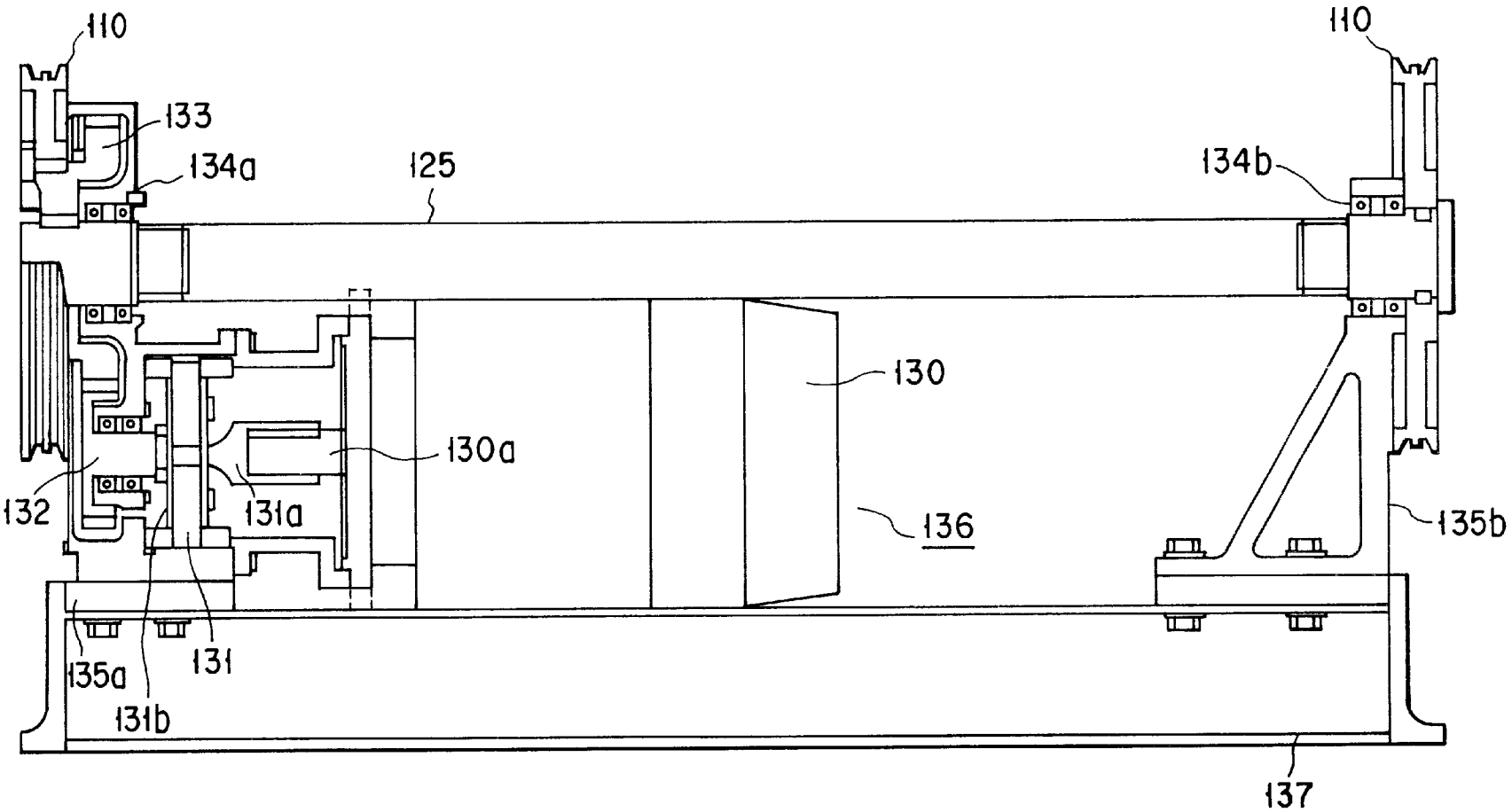
FIG. 10 is a front view showing the first modification of the driving device of the elevator according to the second embodiment of the present invention.

The first modification of the driving device 115 of the second embodiment will be described below with reference to FIG. 10. An output shaft 130*a* of a driving motor 130 is connected directly with an input shaft 131*a* of a planetary gear speed reducer 131. An output shaft 131*b* of the planetary gear speed reducer 131 is connected to a pinion 132. The traction sheaves 110 are connected directly with the output shaft 125. The output shaft 125 has a gear 133 which meshes with the pinion 132. One end of the output shaft 125 is supported by a mounting leg 135*a* having a driving unit 136, which includes, e.g., the driving motor 130 and the planetary gear speed reducer 131, via a support bearing 134*a*. The other end of the output shaft 125 is supported by a mounting leg 135*b* via a support bearing 134*b*.

The operation of this modification is as follows. The rotation of the driving motor 130 is transmitted to the planetary gear speed reducer 131. The amplified torque is transmitted from the output shaft 131*b* of the planetary gear speed reducer 131 to the pinion 132. The speed of power transmitted to the pinion 132 is further reduced by the gear 133 and rotates the output shaft 125. The gear 133 and the traction sheaves 110 are fixed to the same output shaft 125, so the torque transmitted to the gear 133 directly drives the traction sheaves 110.

In addition to the effects of the first embodiment, in this modification using the speed reducer using gears a wide range of speed reducing ratio can be set by combining the gear ratio with the speed reducing step number. Accordingly, various running speeds and driving forces of the elevator can be controlled. Also, if the elevator shaft has a sufficient space, no machine house need to be formed to install the elevator driving device, i.e., the driving device can be installed in the space defined by-the car 101, the elevator shaft wall 103*a,* and the ceiling. Even if the elevator shaft has no space, the size of machine house can be decreased because the driving device is miniaturized.

Figure 11:
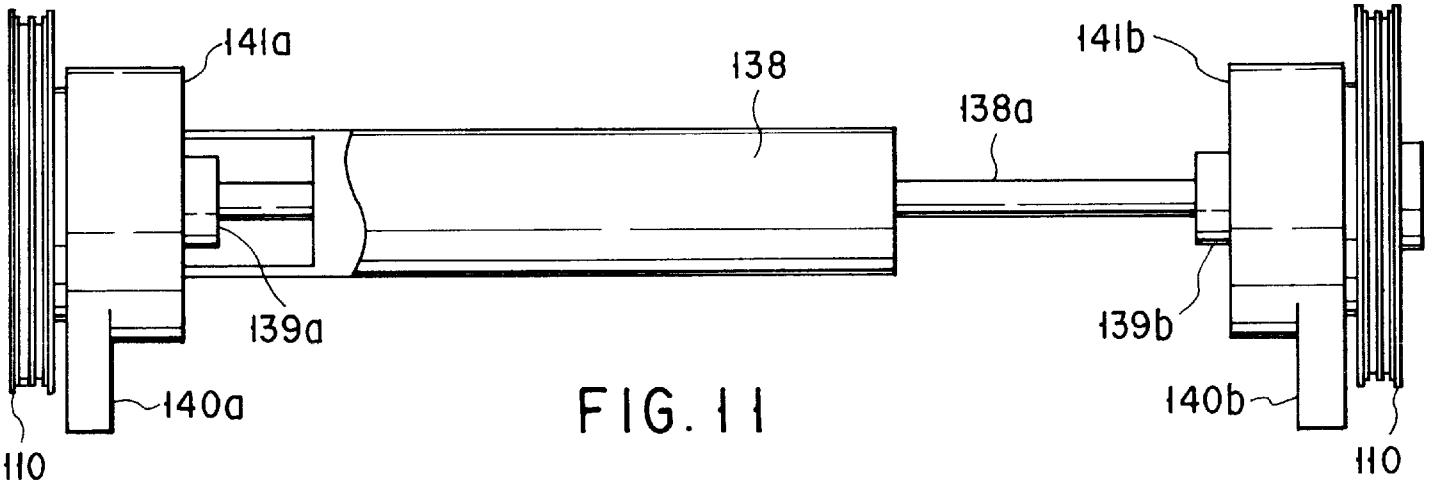
FIG. 11 is a front view showing the second modification of the driving device of the elevator according to the second embodiment of the present invention.
Figure 12:
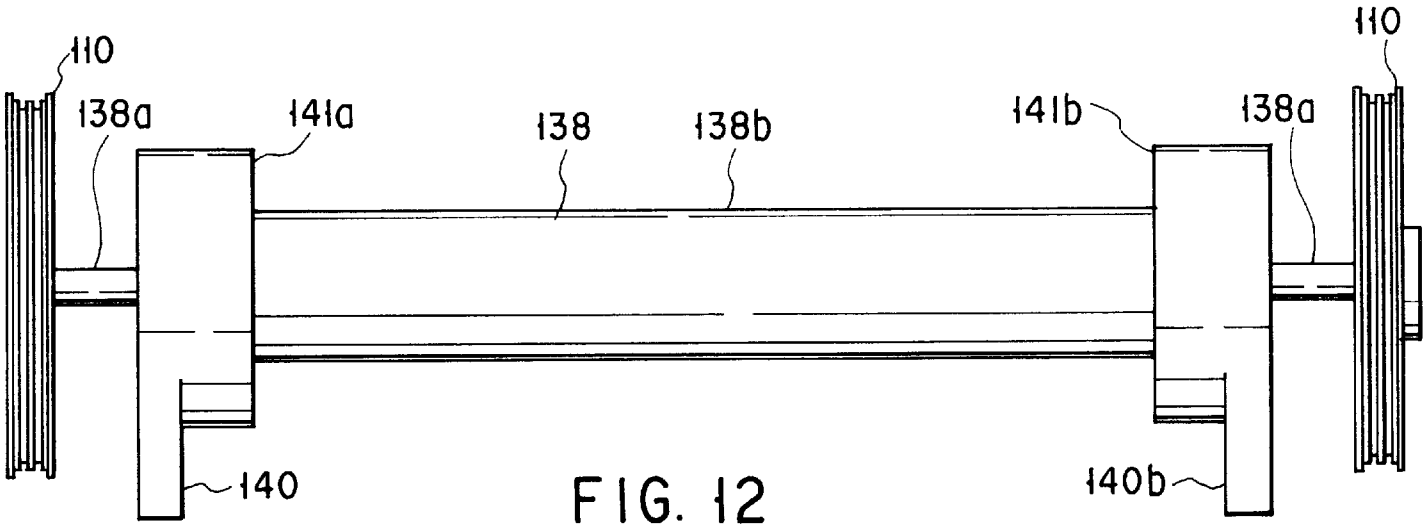
FIG. 12 is a front view showing the second modification of the driving device of the elevator according to the second embodiment of the present invention.

The second modification of the driving device 115 of the second embodiment will be described below with reference to FIGS. 11 and 12. Referring to FIG. 11, output shafts 138*a* extend from the two ends of a driving motor 138 including a brake (not shown). These output shafts 138*a* are connected to speed reducers 141*a* and 141*b* via transmitting means 139*a* and 139*b* such as gears or joints. The speed reducers 141*a* and 141*b* include mounting legs 140*a* and 140*b* on their outer circumferential surfaces. The traction sheaves 110 are fixed to the output sides of these speed reduces 141*a* and 141*b*. Referring to FIG. 12, the output shafts 138*a* extending from the two ends of the driving motor 138 directly function as input shafts of the speed reduces 141*a* and 141*b*. A frame 138*b* of the driving motor 138 is connected to fixing portions of the speed reducers 141*a* and 141*b*.

The operation of this modification is as follows. When the driving motor 138 is rotated, the speed reducers 141*a* and 141*b* are driven via the transmitting means 139*a* and 139*b* or directly. Consequently, the rotational speed and driving force required to vertically move the car 101 are transmitted to the traction sheaves 110 attached to the output sides of the speed reducers 141*a* and 141*b*.

In addition to the effects of the driving devices described previously, in this modification the long transmission path extending across the car 101 in the widthwise direction can transmit high-speed low torque. Consequently, the mechanism between the traction sheaves 110 can be made compact. Additionally, various dimensions of the car 101 and the elevator shaft 103 can be easily changed only by changing the length of this transmission path.

Figure 13:
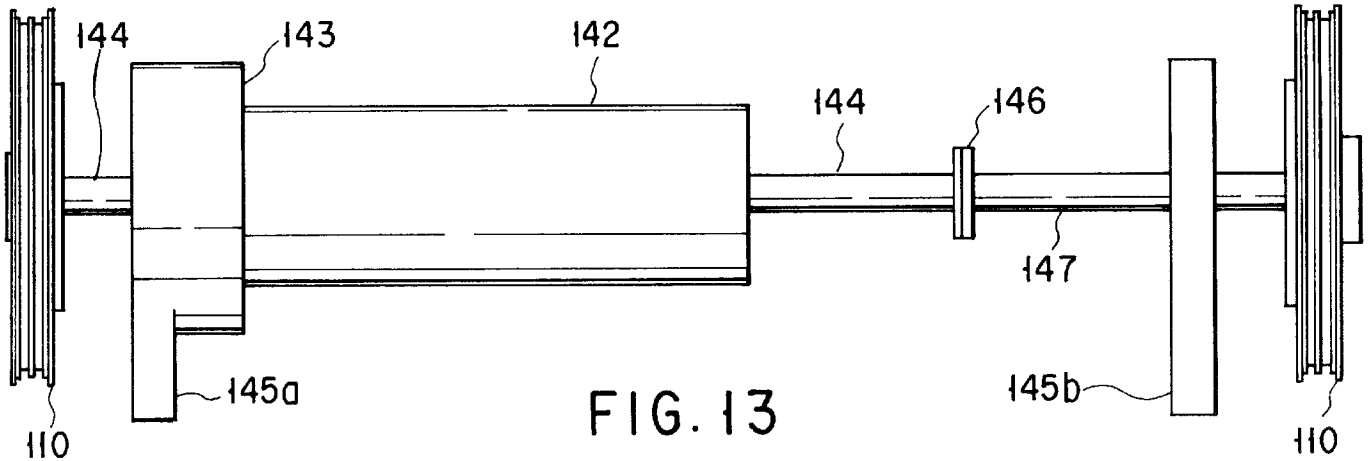
FIG. 13 is a front view showing the third modification of the driving device of the elevator according to the second embodiment of the present invention.
Figure 14:
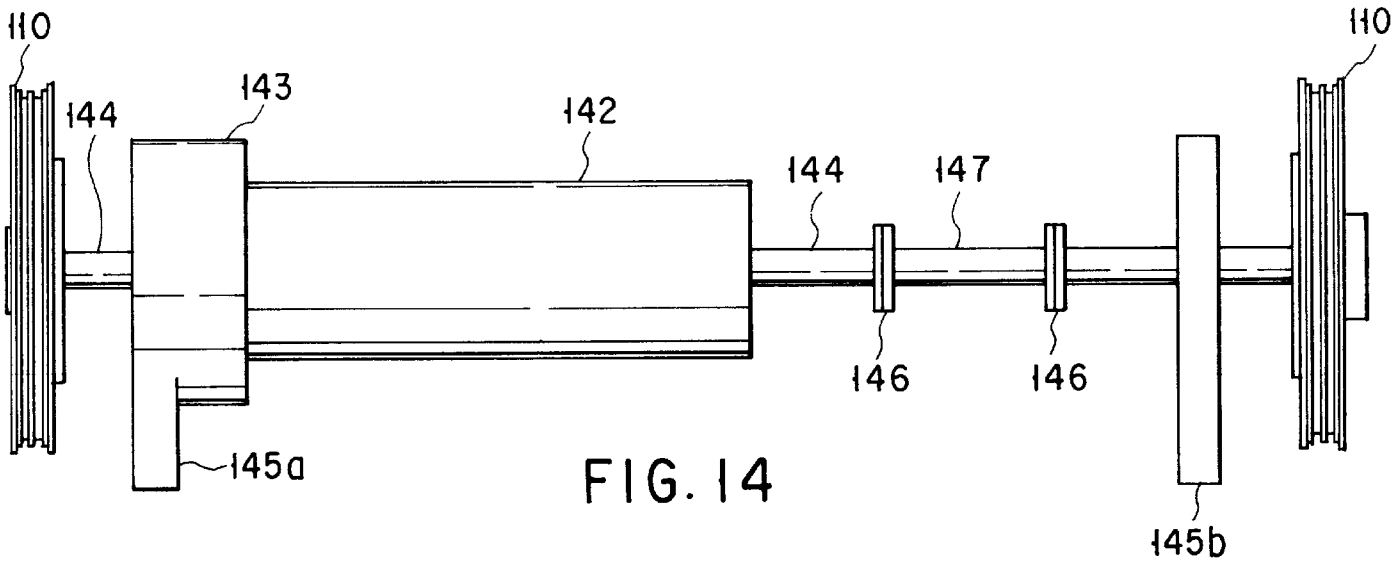
FIG. 14 is a front view showing the third modification of the driving device of the elevator according to the second embodiment of the present invention.
Figure 15:
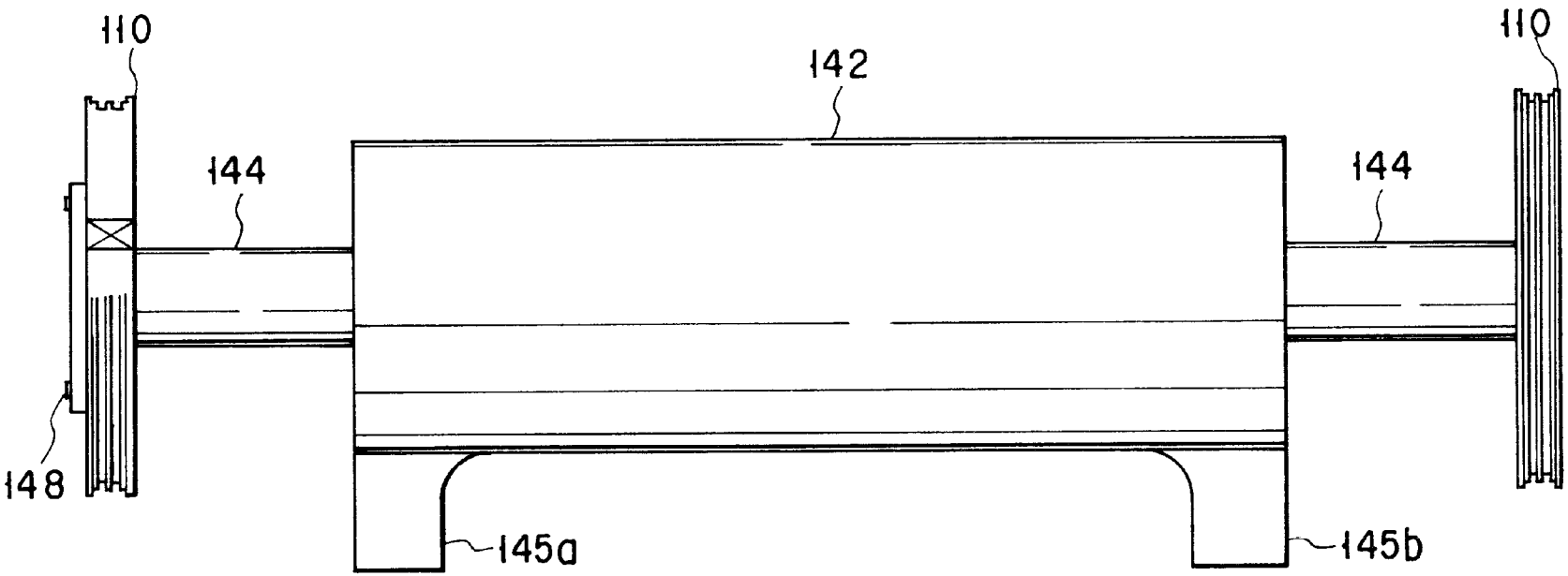
FIG. 15 is a front view showing the third modification of the driving device of the elevator according to the second embodiment of the present invention.

The third modification of the driving device 115 of the second embodiment will be described below with reference to FIGS. 13 to 15. Referring to FIG. 13, a speed reducer 143 is connected to a driving motor 142 including a brake (not shown). The traction sheaves 110 are attached to the two ends of an output shaft 144 of the driving motor 142. A mounting leg 145*a* for supporting this output shaft 144 via a bearing (not shown) is formed on the outer circumferential surface of the speed reducer 143. Another mounting leg 145*b* is formed near the other traction sheave. A joint shaft 147 having a joint 146 for transmitting torque or having two such joints 146 at the two ends, as shown in FIG. 14, is interposed between the output shaft 144 and the mounting leg 145*b*. Also, as shown in:FIG. 15, a detachable fastening member 148 is interposed between at least one traction sheave and the output shaft 144.

In this modification, the assembly dimensions of the elevator driving device 115 can be readily changed in accordance with the dimensions of the car 101 or the elevator shaft 103. Additionally, carrying-in and assembly adjustments can be easily performed during installation. Especially in the modification shown in FIG. 15, the traction sheaves 110 alone can be replaced. This improves the working efficiency.

[Third Embodiment]

Figure 16:
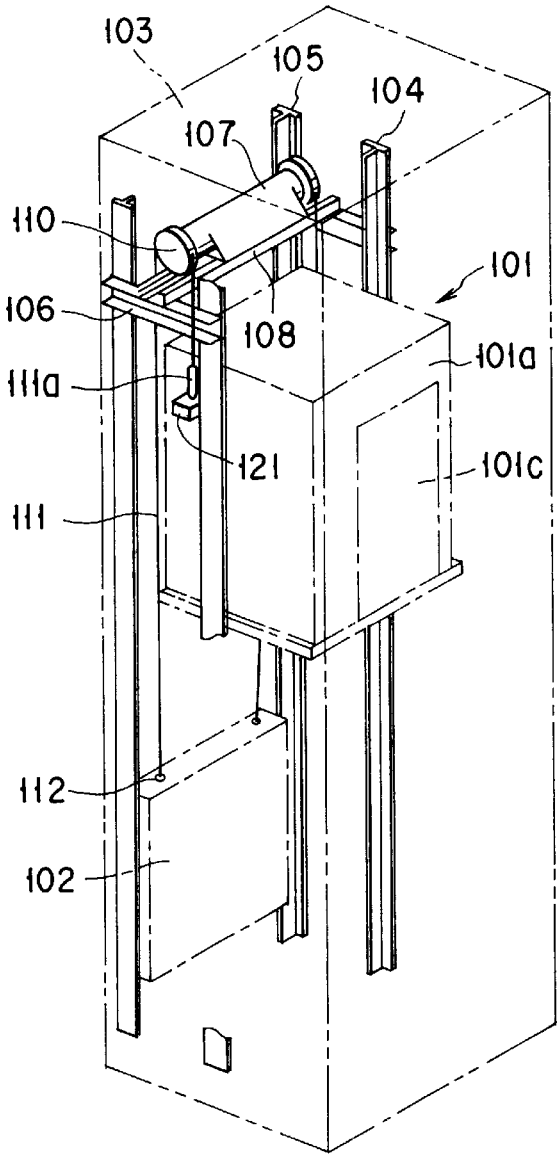
FIG. 16 is a view of the overall arrangement of an elevator according to the third embodiment of the present invention.

FIG. 16 shows the arrangement of a hitch 121 of a rope of an elevator according to the third embodiment of the present invention. The arrangement except for the hitch 121 is identical with that of the first embodiment.

The rope hitch 121 of the elevator of the third embodiment is formed on a car frame 101*b* in a position slightly lower than the ceiling surface of a car 101.

As described above, the hitch 121 of a rope 111 is formed in a sufficiently low position where a shackle rod 111*a* at the end of the rope does not interfere with a driving device 107. Therefore, even when the car 101 ascends to the vicinity of the top of the elevator shaft, the shackle rod 111*a* does not interfere with the driving device 107. Consequently, the height of the elevator shaft can be decreased, and the structure of the car frame 101*b* can be simplified and made light in weight.

[Fourth Embodiment]

Figure 17:
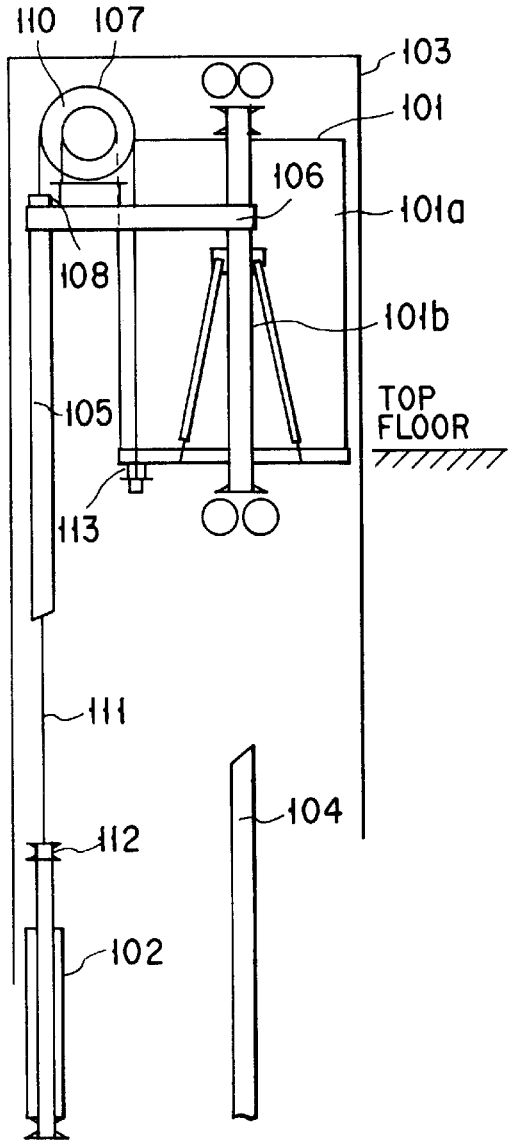
FIG. 17 is a view of the overall arrangement of an elevator according to the fourth embodiment of the present invention.

FIG. 17 shows the arrangement of an elevator according to the fourth embodiment of the present invention.

The elevator of the fourth embodiment is the same as that of the first embodiment except for the position of a driving device 107.

The driving device 107 of the elevator of the fourth embodiment is positioned at the top of an elevator shaft 103 along the vertical extension line of a counterweight 102. Also, the driving device 107 is positioned outside the horizontally projected plane of a car 101. Traction sheaves 110 are positioned between side surfaces 114*a* and 114*b* of the car 101 and the elevator shaft walls and outside the horizontally projected plane of the car 101.

In the elevator of the fourth embodiment as described above, the driving device 107 is placed at the back of the car 101. Also, the traction sheaves 110 are placed near the side surfaces 114*a* and 114*b* of the car 101, i.e., near adjacent wall surfaces 103*b* of the elevator shaft 103. These driving device 107 and traction sheaves 110 are positioned outside the horizontally projected plane of the car 101. Therefore, even when the car 101 ascends to the vicinity of or beyond the driving device 107, the car 101 does not interfere with the driving device 107. Additionally, the height and plane size of the elevator shaft can be decreased.

[Fifth Embodiment]

Figure 18:
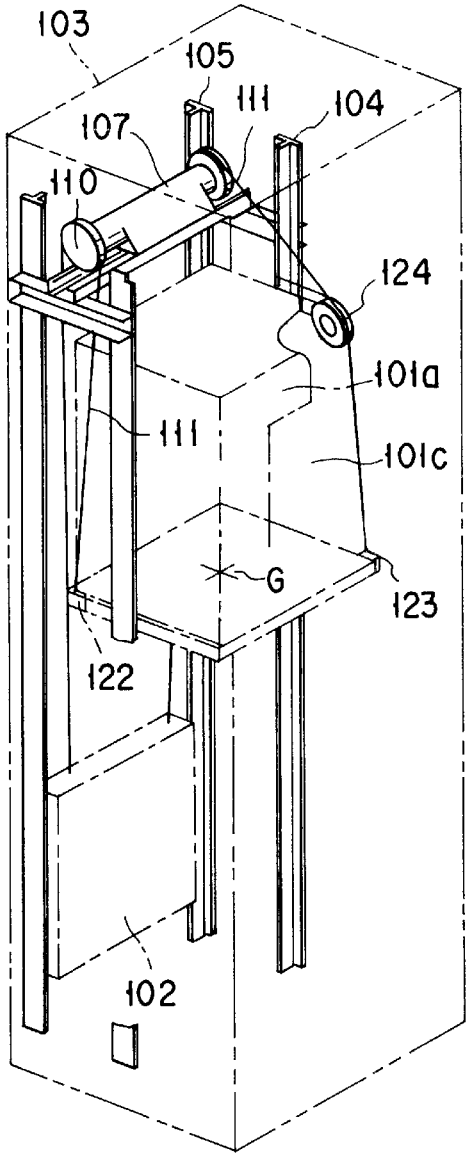
FIG. 18 is a view of the overall arrangement of an elevator according to the fifth embodiment of the present invention.
Figure 19:
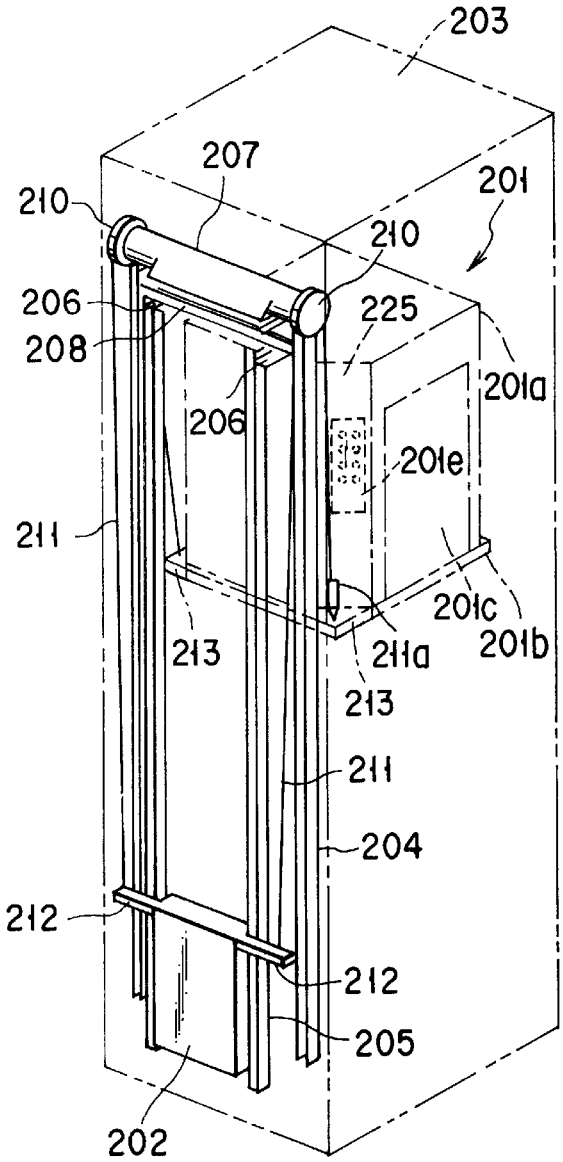
FIG. 19 is a view of the overall arrangement of an elevator according to the sixth embodiment of the present invention.

FIG. 18 shows the arrangement of an elevator according to the fifth embodiment of the present invention.

The elevator of the fifth embodiment is the same as that of the first embodiment except that the hitch positions of the elevator of the first embodiment are changed and a deflection sheave for moving the rope suspending position is used.

In the elevator of the fifth embodiment, a hitch 122 of one of two ropes 111 is formed in the rear (on the counterweight 102 side) of a car 101 when viewed from a doorway lO1*c*. A hitch 123 of the other rope 111 is formed near the doorway of the car 101 such that the positions of these hitches 122 and 123 are symmetrical about a center of gravity G. The suspending position of the rope 111 fixed to the hitch 123 is moved by a deflection sheave 124 fixed to a car guide rail 104 above the car 101.

As described above, the positions of the hitches 122 and 123 of the ropes 111 of the car 101 are symmetrical about the center of gravity G. This prevents easy application of a local load upon guide rails and guide devices (guide rollers) for guiding the car 101. Consequently, the guide rails, guide devices, car frame, and the like can be simplified and made light in weight. The running characteristics of the car 101 also improve.

In the inventions according to the first to fifth embodiments described above, even when the car ascends to the vicinity of the top of the elevator shaft, the car does not interfere with the traction sheaves. Accordingly, the dimension of the driving device at the top of the elevator shaft can be decreased. Also, the plane size of the elevator shaft can be decreased.

The counterweight is positioned at the back of the car when viewed from the doorway. Therefore, even when the dimension of the elevator shaft in the widthwise direction of the doorway cannot be increased, the elevator can be installed without increasing the size of the elevator shaft.

Since the driving device includes a plurality of traction sheaves, the degree of freedom of the suspending positions of the car increases. Consequently, the car can be stably moved up and down.

The frame outside diameter of the driving device is made smaller than the diameter of the traction sheaves. This decreases the height of the elevator shaft.

When the driving device does not include any speed reducer, silent and good running characteristics can be obtained.

When the driving device includes a speed reducer, the driving device itself can be miniaturized.

When the hitches of the ropes are formed below the ceiling surface of the car, the height of the elevator shaft can be decreased. Additionally, the structure of the car frame can be simplified and made light in weight.

When the rope hitches are formed in the lower portion of the car, the height of the elevator shaft can be decreased, and the structure of the car frame can be simplified and made light in weight.

Since the driving device is positioned outside the horizontally projected plane of the car, the height and plane size of the elevator shaft can be decreased.

The portions where the car is suspended by the ropes suspended from a plurality of traction sheaves are substantially symmetrical about the center of gravity of the car. Accordingly, the guide rails, guide devices, car frame, and the like can be simplified and made light in weight. Also, the running characteristics of the car improve.

Alternatively, the portion where the car is suspended by the rope is moved by the deflection sheave placed in the upper portion of the elevator shaft. Consequently, the guide rails, guide devices, car frame, and the like can be simplified and made light in weight, and the running characteristics of the car also improve.

[(Sixth Embodiment]

Figure 20:
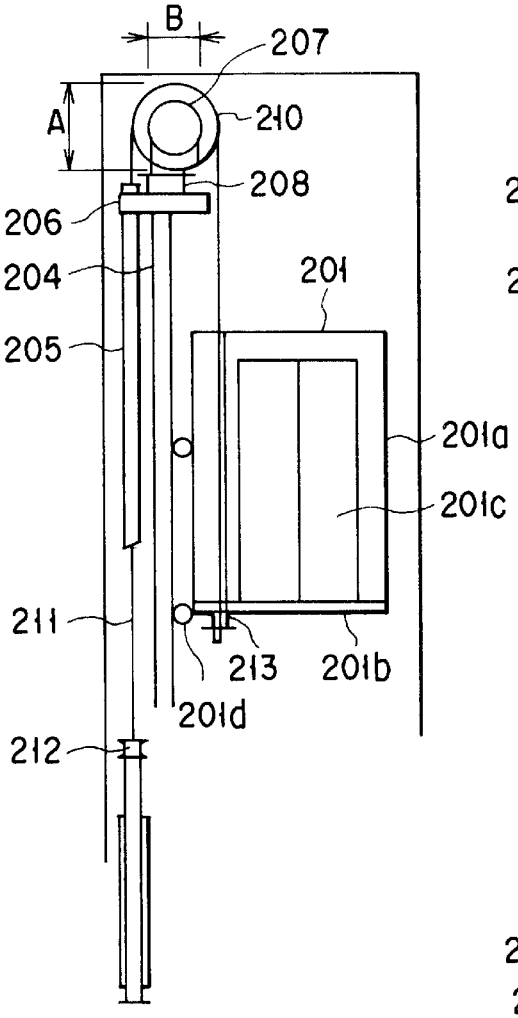
FIG. 20 is a plan view of the elevator according to the sixth embodiment of the present invention.
Figure 21A:
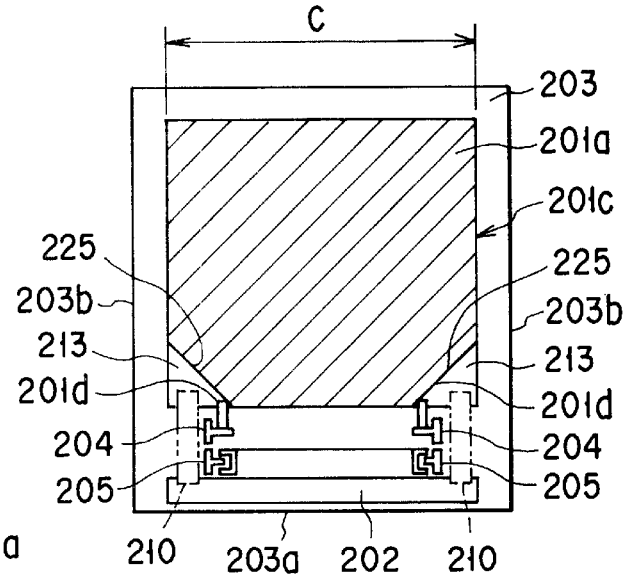
FIGS. 21A and 21B are horizontal sectional views of the elevator according to the sixth embodiment of the present invention.
Figure 21B:
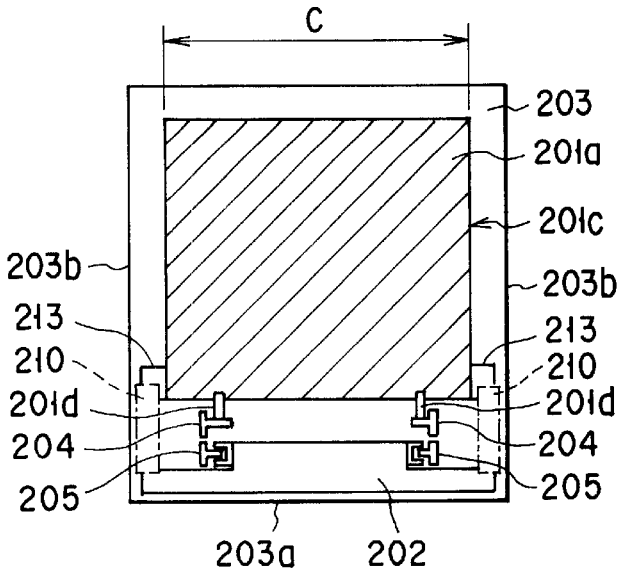

FIGS. 19 to 21B show an outline of an elevator according to the sixth embodiment of the present invention. In the elevator of this embodiment, a pair of car guide rails 204 and a pair of counterweight guide rails 205 for guiding a car 201 and a counterweight 202, respectively, are installed in an elevator shaft 203 in which the car 201 and the counterweight 202 go up and down. As shown in FIGS. 21A and 21B, the car guide rails 204 are positioned close to the counterweight guide rails 205.

The car 201 includes a car room 201*a* for accommodating passengers, a car frame 201*b* for supporting the car room 201*a,* and a doorway 201*c*. The car 201 also includes guide rollers 201d for guiding ascent and descent by contacting the guide rails 204. The car 201 further has notches 225 for positioning traction sheaves 210 outside the horizontally projected plane of the car 201. Additionally, a car control panel 201*e* having buttons for designating floors and the like is placed in the corner near the doorway 201*c* and the counterweight 202.

A pair of connecting beams 206 extend across the tops of the car guide rails 204 and the counterweight guide rails 205. A support beam 208 for mounting a driving device 207 extends across the connecting beams 206.

The driving device 207 mounted on the support beam 208 is a gearless driving device having no speed reducer. This driving device 207 includes a hoisting device (hoisting motor), a brake, a frame for supporting the hoisting device and the brake, and support members for fixing the driving device 207 to the support beam 208. The driving traction sheaves 210 are attached to the two ends of the hoisting device. Note that this traction sheave 210 can also be attached only to one end of the driving device 207.

Ropes 211 are wound around these traction sheaves 210 like well buckets. One end of each rope 211 is connected to a rope hitch 212 in the upper portion of the counterweight 202. The other end of each rope 211 is attached to a hitch 213 formed on the car frame 201*b* in the lower portion of the car 201 via a shackle rod 211*a*. Two such hitches 213 are formed in substantially symmetrical positions on the side surface side (on the counterweight 202 side) of the car 201 when viewed from the doorway 201*c* of the car 201. Note that only one hitch is necessary if the traction sheave 210 is attached only to one end of the driving device 207.

The counterweight 202 is placed on the side of the car 201 when viewed from the doorway 201*c* of the car 201. The driving device 207 is positioned at the top of the elevator shaft 203 along the vertical extension line of the counterweight 202.

FIGS. 21A and 21B are horizontal sectional views of the elevator of the sixth embodiment. As shown in FIG. 21A, the traction sheaves 210 attached to the two ends of the hoisting device of the driving device 207 are placed near wall surfaces 203*b* of the elevator shaft 203, which are adjacent to a wall surface 203*a* facing the counterweight 202, and are positioned outside the horizontally projected plane of the car 201. In this embodiment, the traction sheaves 210 are positioned within a depth C of the car 201. However, as shown in FIG. 21B, the traction sheaves 210 can also be positioned closer to the adjacent wall surfaces 203*b*. If this is the case, the notches 225 of the car 201 can be eliminated or decreased in size. Also, as shown in FIG. 20, a frame outside diameter B (outside diameter of the hoisting motor) of the driving device 207 is made smaller than a diameter A of the traction sheaves 210.

The operation of the elevator according to the sixth embodiment with the above arrangement will be described below.

When the hoisting device of the driving device 207 is driven, the traction sheaves 210 connected directly with the two ends of the hoisting device rotate, and the ropes 211 are driven by the static frictional force (traction) between the traction sheaves 210 and the ropes 211. Consequently, the car 201 and the counterweight 202 connected to the ropes 211 move up and down along the guide rails 204 and 205, respectively.

In the above elevator of the sixth embodiment, the traction sheaves 210 attached to the two ends of the hoisting device of the driving device 207 are placed near the adjacent wall surfaces 203*b* so as to be positioned outside the horizontally projected plane of the car 201. Therefore, even when the car 201 ascends to the vicinity of the top of the elevator shaft, the traction sheaves 210 do not interfere with the car 201. Consequently, the dimension of the driving device 207 at the top of the elevator shaft can be decreased. Additionally, the horizontal sectional size of the elevator shaft can be decreased.

The counterweight 202 and the driving device 207 are installed on the side of the car 201. Accordingly, even in an elevator shaft in which the depth of the car 201 cannot be increased, the elevator can be installed without increasing the elevator shaft size. Also, the notches 225 are formed in the car 201 to allow the traction sheaves 210 to be placed within the depth C of the car 201. Consequently, the elevator shaft size can be effectively used.

The traction sheaves 210 are attached to the two ends of the hoisting device of the driving device 207. This increases the degree of freedom of the positions where the car 201 is suspended. Consequently, the car 201 can be stably moved up and down.

The use of the hoisting motor having a smaller diameter than the diameter of the traction sheave 210 decreases the dimension of the driving device 207 at the top of the elevator shaft.

The driving device 207 does not use any speed reducer, so silent and good running characteristics can be obtained The hitches 213 of the car frame 201*b* are formed in the lower portion of the car 201. Therefore, the height of the elevator shaft can be decreased, and the structure of the car frame 201*b* can be simplified and made light in weight.

Also, the hitches 213 are formed in two substantially symmetrical positions on the side (the counterweight 202 side) of the car 201 when viewed from the doorway 201*c* of the car 201. Accordingly, well-balanced good running characteristics can be obtained.

The car control panel 201*e* is positioned in the corner near the doorway 201*c* and the counterweight 202. Hence, it is possible to easily ensure the working space for installing and inspecting the car control panel 20l*e* and reduce the work load.

Since the car guide rails 204 are positioned close to the counterweight guide rails 205, the building space can be effectively used. Also, it is possible to ensure a working space for installation and reduce the work load.

[Seventh Embodiment]

Figure 22:
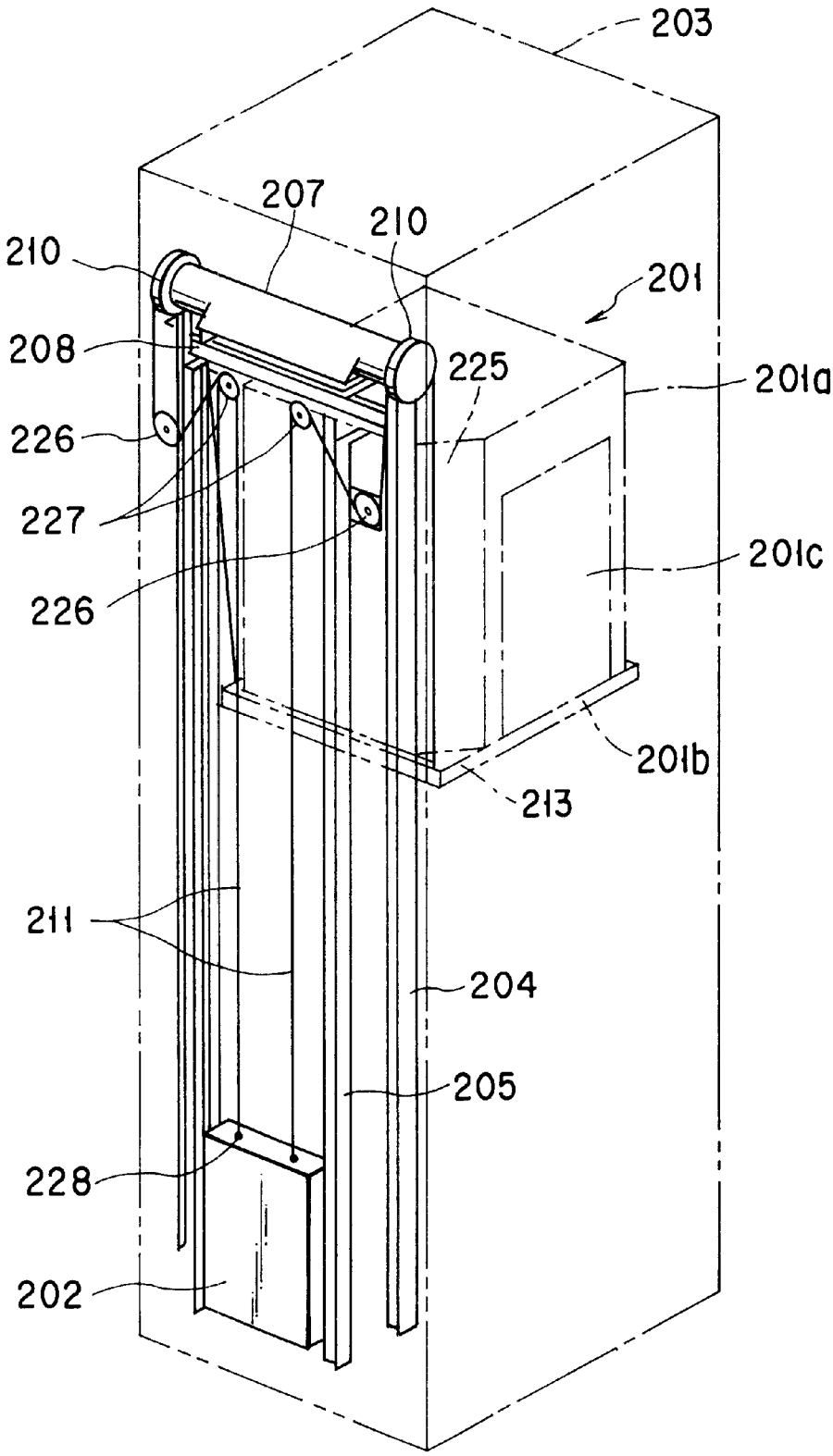
FIG. 22 is a view of the overall arrangement of an elevator according to the seventh embodiment of the present invention.

FIG. 22 shows the arrangement of an elevator according to the seventh embodiment of the present invention. In this embodiment, the positions of the hitches 212 of the ropes 211 in the sixth embodiment are moved in the direction of the center of gravity of the counterweight 202 by using deflection sheaves.

The elevator of this embodiment is characterized by adding the following arrangement to the elevator of the sixth embodiment.

That is, first deflection sheaves 226 engaging with ropes 211 suspended from traction sheaves 210 are attached to counterweight guide rails 205. Additionally, second deflection sheaves 227 engaging with the ropes 211 fed via the first deflection sheaves 226 are attached to a support beam 208. The end portions of the ropes 211 suspended from the second deflection sheaves 227 are fixed to hitches 228 of a counterweight 202. With these first deflection sheaves 226 and second deflection sheaves 227, the hitches 228 connecting the ropes 211 with the counterweight 202 can be moved in the direction of the center of gravity of the counterweight 202. This eliminates the need for arms such as the hitches 212 in the sixth embodiment.

Figure 23A:
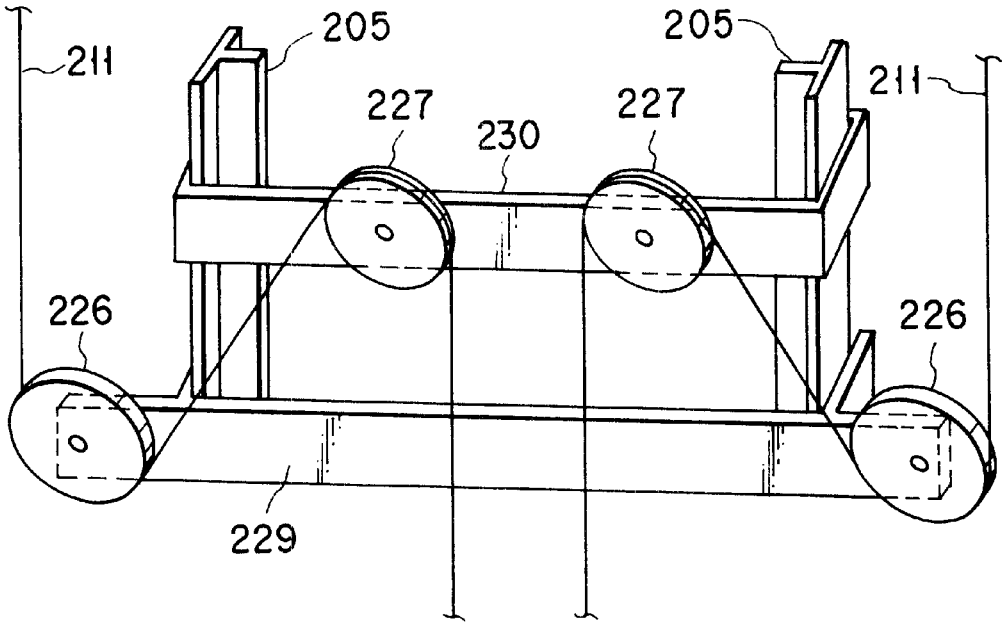
FIGS. 23A and 23B are perspective views of the main components of deflection sheaves of the elevator according to the seventh embodiment of the present invention.
Figure 23B:
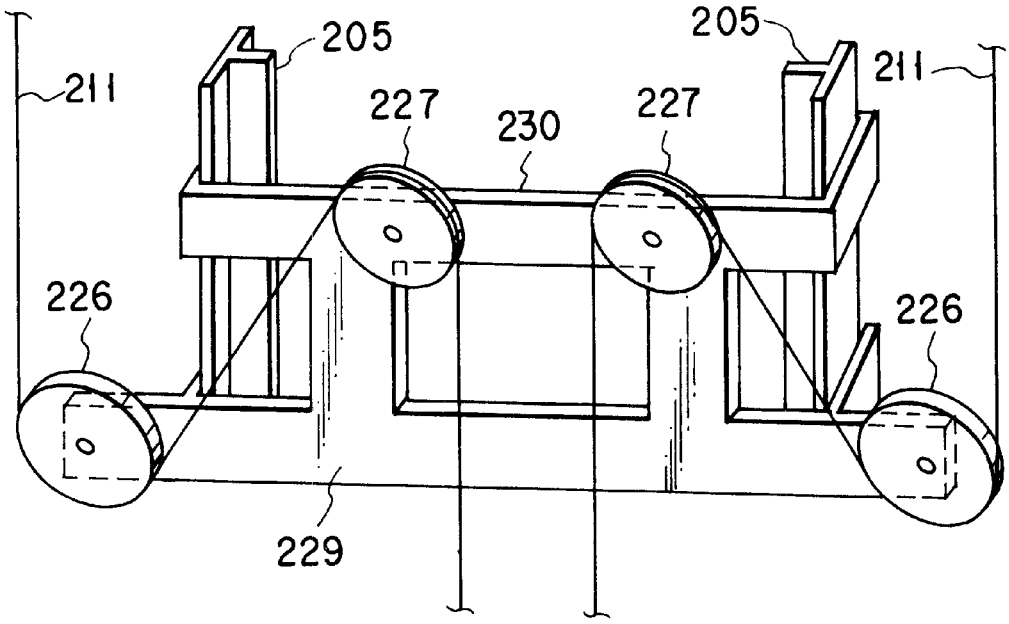

FIGS. 23A and 23B show modifications of the structure for attaching the first deflection sheaves 226 and the second deflection sheaves 227. In the modification shown in FIG. 23A, the first deflection sheaves 226 and the second deflection sheaves 227 are fixed to support frames 229 and 230, respectively, which are fixed to the counterweight guide rails 205. In the modification shown in FIG. 23B, these support frames 229 and 230 are integrated.

[Eighth Embodiment]

Figure 24A:
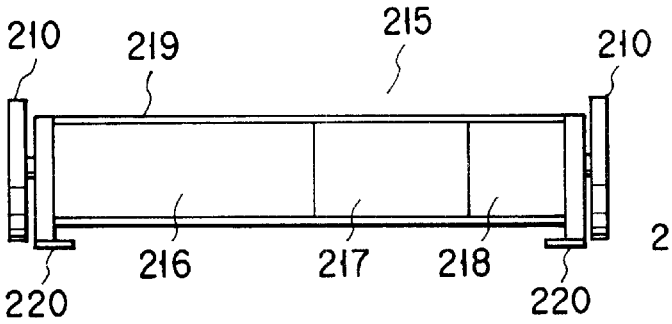
FIGS. 24A and 24B are views showing the arrangement of a driving device of an elevator according to the eighth embodiment of the present invention.
Figure 24B:
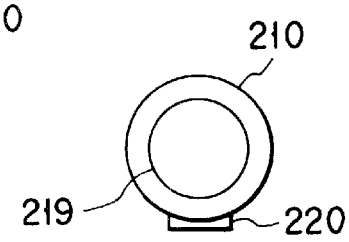

FIGS. 24A and 24B show the arrangement of a driving device of an elevator according to the eighth embodiment of the present invention. The arrangement except for this driving device is identical with that of the sixth embodiment.

A driving device 215 of the elevator shown in FIGS. 24A and 24B include a hoisting device 216, a speed reducer 217, a brake 218, a frame 219 for supporting the hoisting device and the brake, and support portions 220 to be fixed to a support beam 208. Traction sheaves 210 are attached to output shafts at the two ends of the driving device 215.

In the driving device 215 with this arrangement, the hoisting device 216 is driven, and its rotational force is applied to the traction sheaves 210 via the speed reducer 217. Accordingly, unlike the gearless driving device 207, the hoisting device 216 and the brake 218 can be miniaturized.

[Ninth Embodiment]

Figure 25:
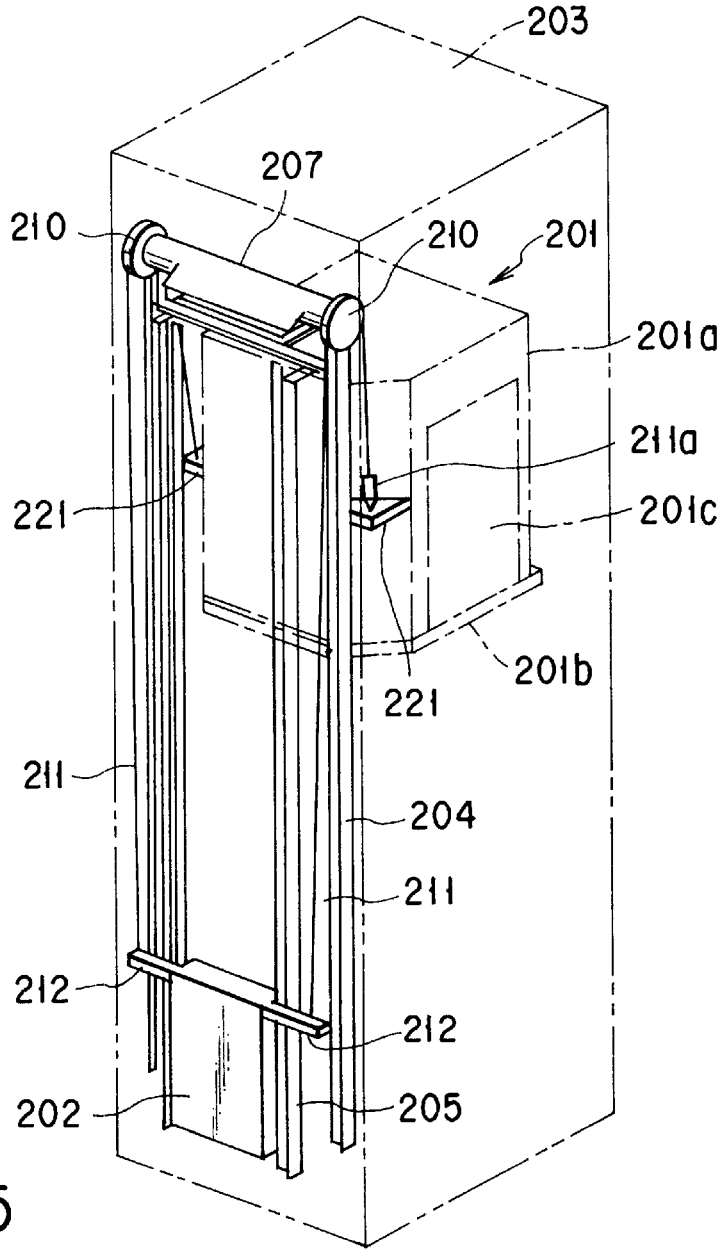
FIG. 25 is a view of the overall arrangement of an elevator according to the ninth embodiment of the present invention.

FIG. 25 shows the arrangement of hitches 221 of ropes of an elevator according to the ninth embodiment of the present invention. The arrangement except for the hitches 221 is identical with that of the sixth embodiment.

The rope hitches 221 of the elevator of the ninth embodiment are formed in positions slightly lower than the ceiling surface of a car 201.

As described above, the hitches 221 of ropes 211 are formed in sufficiently low positions where shackle rods 211*a* at the ends of the ropes do not interfere with a driving device 207. Therefore, even when the car 201 ascends to the vicinity of the top of the elevator shaft, the shackle rods 211*a* do not interfere with the driving device 207. Consequently, the height of the elevator shaft can be decreased.

[10th Embodiment]

Figure 26:
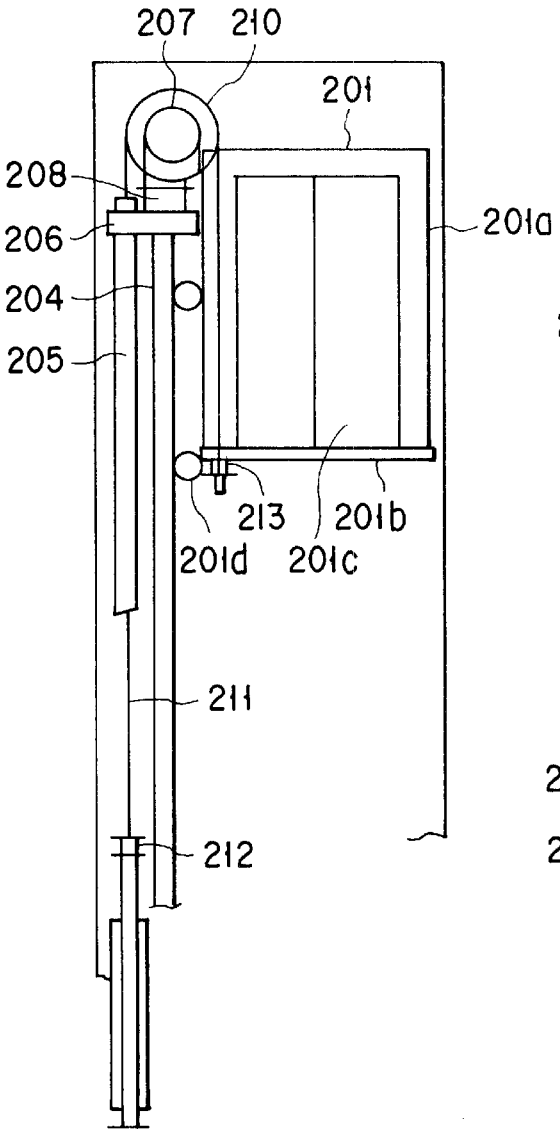
FIG. 26 is a plan view of an elevator according to the 10th embodiment of the present invention.

FIG. 26 shows the arrangement of an elevator according to the 10th embodiment of the present invention.

The elevator of the 10th embodiment is the same as that of the sixth embodiment except for the position of a driving device 207. The driving device 207 of the elevator of the 10th embodiment is positioned at the top of an elevator shaft 203 along the vertical extension line of a counterweight 202 and outside the horizontally projected plane of a car 201. Traction sheaves 210 are positioned close to adjacent wall surfaces 203b and outside the horizontally projected plane of the car 201.

In the elevator of the 10th embodiment as described above, the driving device 207 is placed on the side of the car 201. Also, the traction sheaves 210 are placed near the adjacent wall surfaces 203*b* of the elevator shaft 203. These driving device 207 and traction sheaves 210 are positioned outside the horizontally projected plane of the car 101. Therefore, even when the car 201 ascends to the vicinity of or beyond the driving device 207, the car 201 does not interfere with the driving device 207. Additionally, the height and plane size of the elevator shaft can be decreased.

[11th Embodiment]

Figure 27:
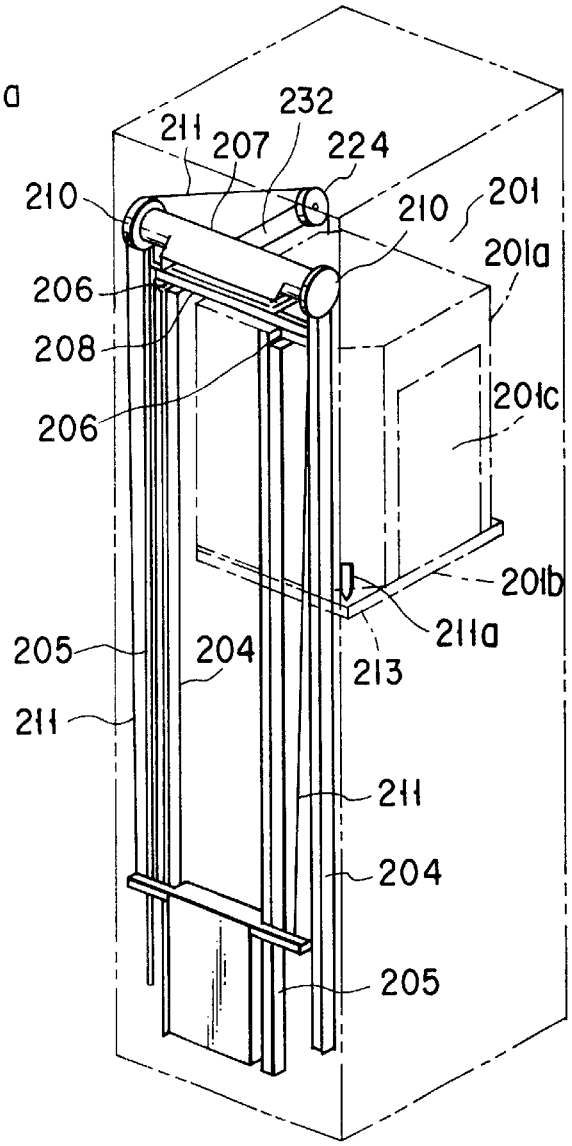
FIG. 27 is a view of the overall arrangement of an elevator according to the 11th embodiment of the present invention.
Figure 28:
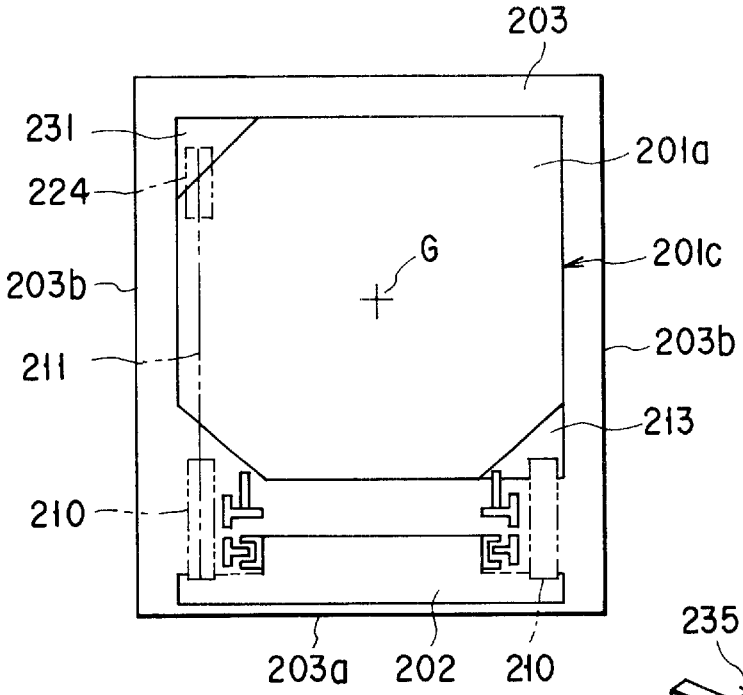
FIG. 28 is a horizontal sectional view of the elevator according to the 11th embodiment of the present invention.

FIGS. 27 and 28 show the arrangement of an elevator according to the 11th embodiment of the present invention.

The elevator of the 11th embodiment is the same as that of the sixth embodiment except that the hitch positions of the elevator of the sixth embodiment are changed and a deflection sheave for moving the rope suspending position is used.

In the elevator of the 11th embodiment, a hitch 231 of one of two ropes 211 is formed in the rear of a car 201 when viewed from a doorway 201*c*. A hitch 213 of the other rope 211 is formed near the doorway of the car 201 such that the positions of the hitches 213 and 231 are symmetrical about a center of gravity G. The suspending position of the rope 211 fixed to the hitch 231 is moved by a deflection sheave 224 fixed to a car guide rail 204 above the car 201 via an arm 232.

As described above, the positions of the hitches 213 and 231 of the ropes 211 of the car 201 are symmetrical about the center of gravity G. This prevents easy application of a local load upon the guide rails and guide devices (guide rollers) for guiding the car 201. Consequently, the guide rails, guide devices, car frame, and the like can be simplified and made light in weight. The running characteristics of the car 201 also improve.

[12th Embodiment]

Figure 29:
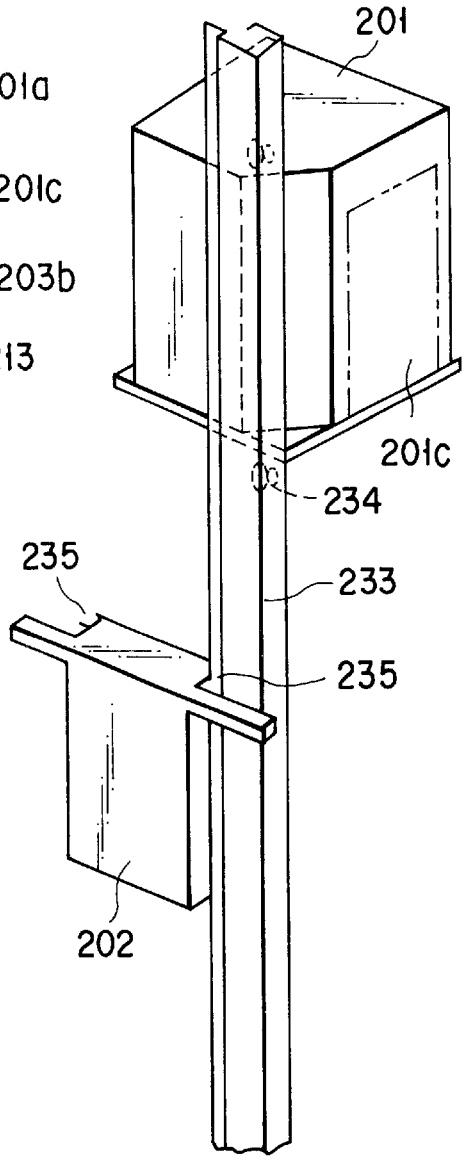
FIG. 29 is a perspective view showing the arrangement of a guide rail of an elevator according to the 12th embodiment of the present invention.
Figure 30:
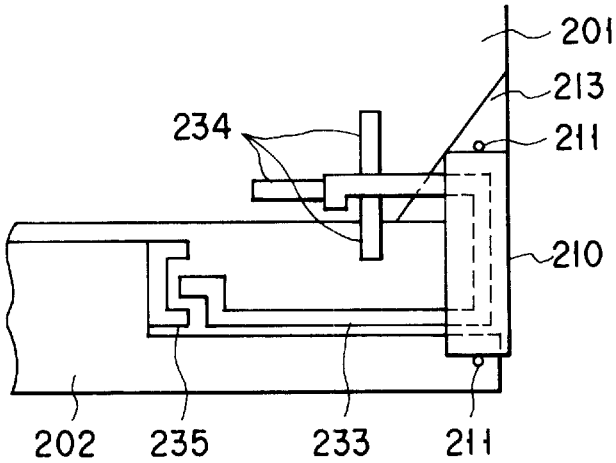
FIG. 30 is a sectional view of the guide rail of the elevator according to the 12th embodiment of the present invention.

FIGS. 29 and 30 show the arrangement of a guide rail of an elevator according to the 12th embodiment of the present invention.

The elevator of the 12th embodiment has the same arrangement as that of the sixth embodiment except that the car guide rails 204 and the counterweight guide rails 205 of the elevator of the sixth embodiment are integrated.

In the elevator of the 12th embodiment, as shown in FIG. 29, a pair of common guide rails 233 (only one of them is shown) obtained by integrating elevator car guide rails and counterweight guide rails guide a car 201 and a counterweight 202. As shown in FIG. 30, the common guide rail 233 has a substantially U sectional shape. Three guide rollers 234 of the car 201 are guided in contact with one end portion of the U shape. A guide shoe 235 of the counterweight 202 slides along the other end portion of the U shape.

In the 12th embodiment as described above, the elevator car guide rails and counterweight guide rails are integrated. Accordingly, it is possible to more effectively use the elevator shaft space and reduce the number of installation steps.

In the inventions according to the sixth to 12th embodiments described above, even when the car ascends to the vicinity of the top of the elevator shaft, the car does not interfere with the traction sheaves. Accordingly, the dimension of the driving device at the top of the elevator shaft can be decreased. Also, the plane size of the elevator shaft can be decreased.

The traction sheaves are attached to the two ends of the driving device. This increases the degree of freedom of the suspending positions of the car, so the car can be stably moved up and down.

The deflection sheaves are placed below the traction sheaves to move the hitches for connecting the ropes with the counterweight in the direction of the center of gravity of the counterweight. This increases the degree of freedom of the suspending positions of the counterweight, so the counterweight can be stably moved up and down. The structure of the counterweight can also be simplified.

The first deflection sheaves are placed below the traction sheaves, and the second deflection sheaves are placed above the first deflection sheaves. The second deflection sheaves are positioned close to the center of gravity of the counterweight. The support frames for fixing these first and second deflection sheaves are attached to the guide rails. This increases the degree of freedom of the suspending positions of the counterweight, so the counterweight can be stably moved up and down. The structure of the counterweight can also be simplified.

When the support frames are integrated, it is possible to stably move the counterweight vertically and simplify the structure of the support frames.

The traction sheaves are positioned within the depth of the car, and the notches are formed in the car to prevent interference between the traction sheaves and the horizontally projected plane of the car. Consequently, the dimension in the direction of depth of the car can be effectively used.

The frame outside diameter of the driving device is made smaller than the diameter of the traction sheaves. This decreases the height and plane size of the elevator shaft.

When the driving device does not include any speed reducer, silent and good running characteristics can be obtained.

When the driving device includes a speed reducer, the driving device itself can be miniaturized.

When the hitches of the ropes are formed below the ceiling surface of the car, the height of the elevator shaft can be decreased. Additionally, the structure of the car frame can be simplified and made light in weight.

When the rope hitches are formed in the lower portion of the car, the height of the elevator shaft can be decreased, and the structure of the car frame can be simplified and made light in weight.

Since the driving device is positioned outside the horizontally projected plane of the car, the height and plane size of the elevator shaft can be decreased.

The positions where the car is suspended by the ropes suspended from a plurality of traction sheaves are substantially symmetrical about the center of gravity of the car. Accordingly, the guide rails, guide devices, car frame, and the like can be simplified and made light in weight. Also, the running characteristics of the car improve.

Alternatively, the position where the car is suspended by the rope is moved by the deflection sheave placed in the upper portion of the elevator shaft. Consequently, the guide rails, guide devices, car frame, and the like can be simplified and made light in weight, and the running characteristics of the car also improve.

The car guide rails are positioned close to the counterweight guide rails. Accordingly, it is possible to effectively use the elevator shaft space and reduce the installation-inspection work load.

When the car guide rails and the counterweight guide rails are integrated, the car and the counterweight can be stably moved up and down. Also, the structure of guide rails can be simplified.

Since the car control panel is positioned on the counterweight side of the car, it is possible to reduce the installation-inspection work load of the car control panel.

[13th Embodiment]

FIGS. 31 to 34 show an outline of the an elevator according to the 13th embodiment of the present invention. In the elevator of this embodiment, a pair of car guide rails 301*a* and 301*b* and a pair of counterweight guide rails 302*a* and 302*b* for guiding a car 304 and a counterweight 305, respectively, are installed in an elevator shaft 331 in which the car 304 and the counterweight 305 go up and down.

The car 304 includes a car room 304*a* for accommodating passengers, a car frame 304*b* for supporting the car room 304*a,* and a doorway 304*c.*

A pair of support beams 303*a* and 303*b* extend across the tops of the car guide rails 301*a* and 301*b* and the counterweight guide rails 302*a* and 302*b.* Channel bars 307 for mounting a driving device 306 extend across the support beams 303*a* and 303*b.*

The driving device 306 mounted on the channel bars 307 is a gearless driving device having no speed reducer. This driving device 306 includes a hoisting device (driving motor), a brake, a frame for supporting the hoisting device and the brake, and support members for fixing the driving device 306 to the channel bar 307. Driving traction sheaves 309 are attached to the two ends of the hoisting device.

Ropes 310 are wound around these traction sheaves 309 like well buckets. One end of each rope 310 is connected to a rope hitch 332 in the upper portion of the counterweight 305. The other end of each rope 310 is attached to a hitch 333 formed on the car frame 304*b* in the lower portion of the car 304 via a shackle rod 334. Two such hitches 333 are formed in substantially symmetrical positions in the rear (on the counterweight 305 side) of the car 304 when viewed from the doorway 304*c.*

The counterweight 305 is placed at the back of the car 304 when viewed from the doorway 304*c*. The driving device 306 is positioned at the top of the elevator shaft 331 along the vertical extension line of the counterweight 305.

Figure 32:
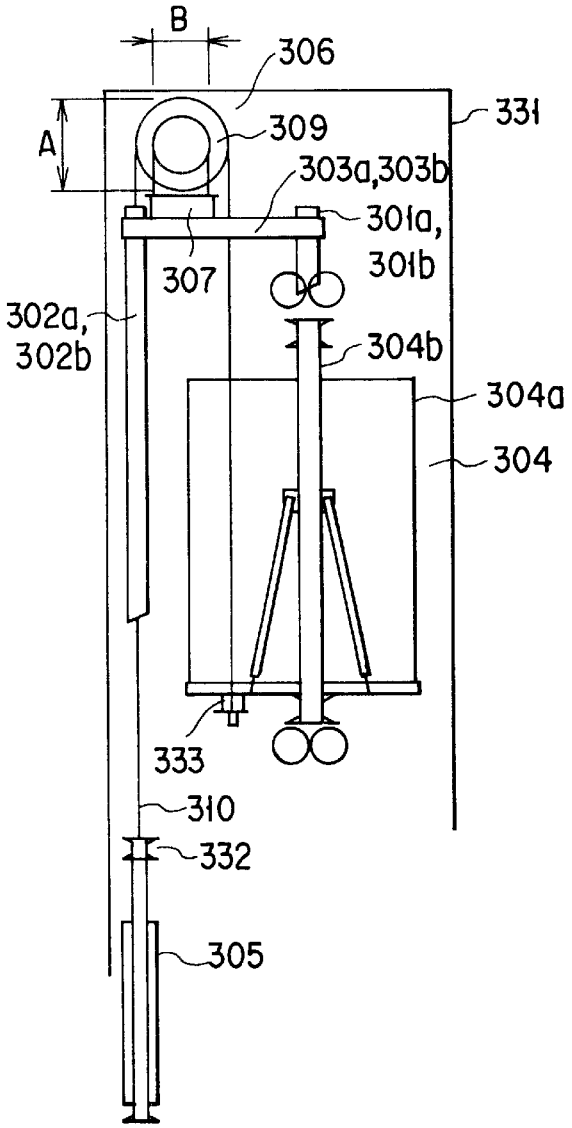
FIG. 32 is a side view showing the overall arrangement of the elevator according to the 13th embodiment of the present invention.
Figure 33:
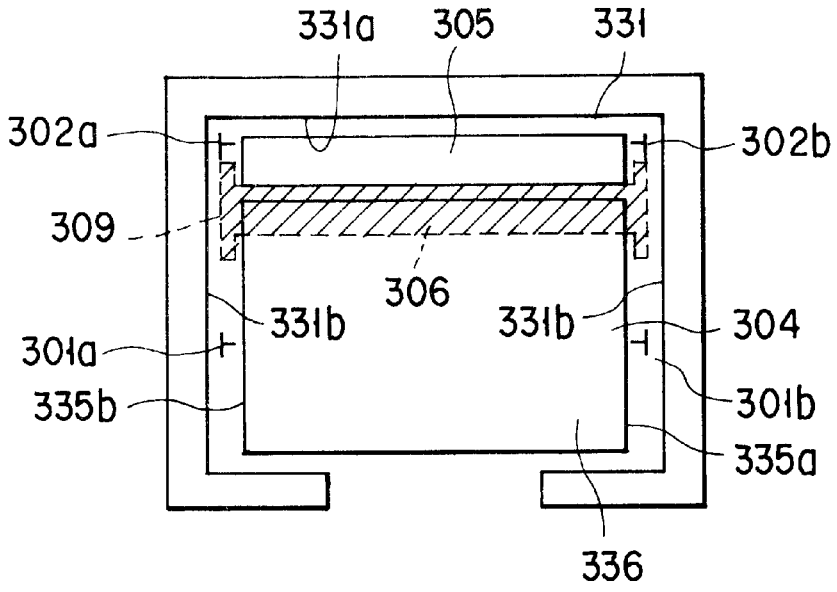
FIG. 33 is a horizontal sectional view of the elevator according to the 13th embodiment of the present invention.

FIG. 33 is a horizontal sectional view of the elevator of the 13th embodiment. As shown in FIG. 33, the driving device 306 is long in the widthwise direction when viewed from the doorway. The traction sheaves 309 attached to the two ends of the driving motor of the driving device 306 are placed near wall surfaces 331*b* of the elevator shaft 331, which are adjacent to a wall surface 331*a* facing the counterweight 305. More specifically, the traction sheaves 309 are positioned between side surfaces 335*a* and 335*b* (adjacent to the surface of the car which opposes the counterweight 305) of the car 304 and the adjacent wall surfaces 331*b* of the elevator shaft 331 and outside the horizontally projected plane of the car. Also, as shown in FIG. 32, a frame outside diameter B (outside diameter of the hoisting motor) of the driving device 306 is made smaller than a diameter A of the traction sheaves 309.

The support structure of the driving device 306 will be described below with reference to FIG. 34.

Figure 34:
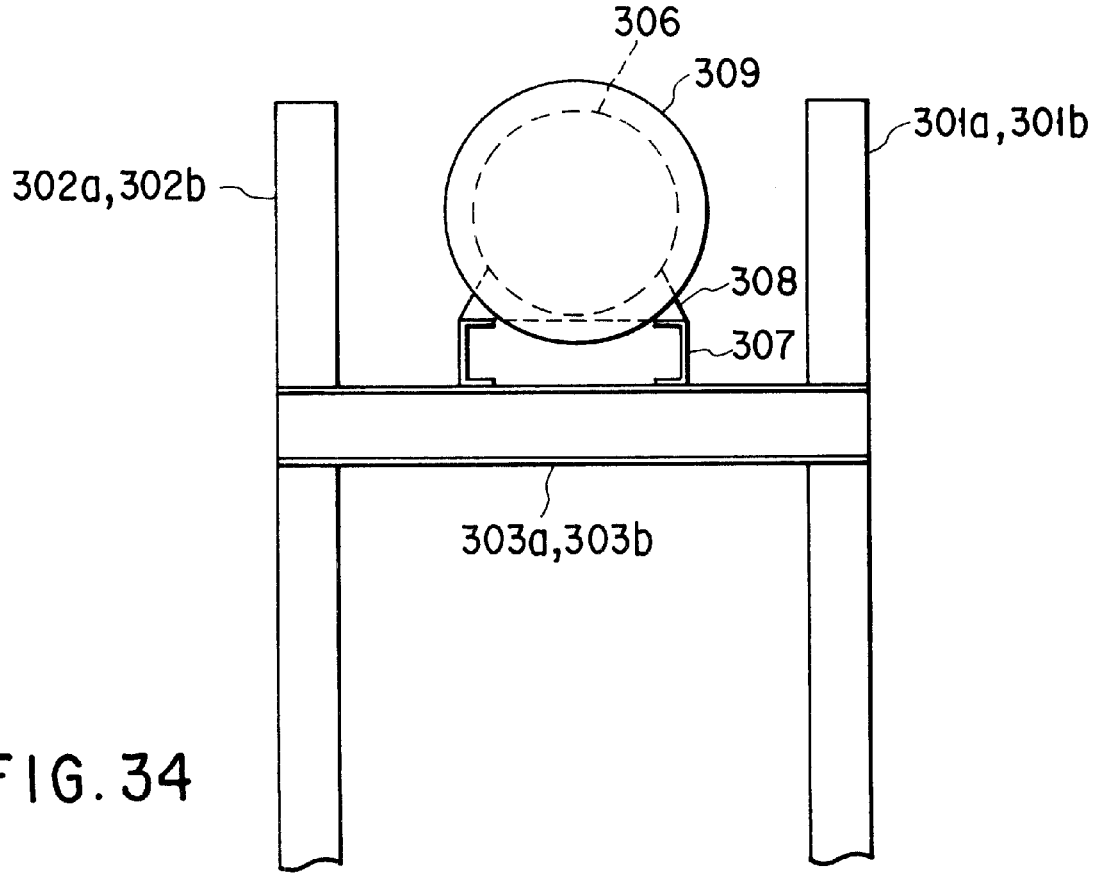
FIG. 34 is a side view showing a driving device of the elevator according to the 13th embodiment of the present invention.

Referring to FIG. 34, the left and right support beams 303*a* and 303*b* are horizontally fixed on the same level between the car guide rails 301*a* and 301*b* for guiding the car 304 and the counterweight guide rails 302*a* and 302*b* for guiding the counterweight 305. The guide rails 301*a*, 301*b*, 302*a*, and 302*b* and the support beams 303*a* and 303*b* are securely fixed by bolts and nuts.

The two channel bars 307 for supporting the lower portion of the driving device 306 are placed on the upper surfaces of the left and right support beams 303*a* and 303*b*. A mounting leg 308 formed in the lower portion of the elevator driving device 306 is placed on the upper surfaces of the channel bars 307 and fixed by bolts and nuts. At the two ends of the driving device 306, the traction sheaves 309 for driving the elevator protrude toward the guide rails 301*a*, 301*b*, 302*a*, and 302*b*. The ropes 310 for connecting the car 304 with the counterweight 305 are wound around these traction sheaves 309.

The operation of this embodiment will be described below.

Figure 31:
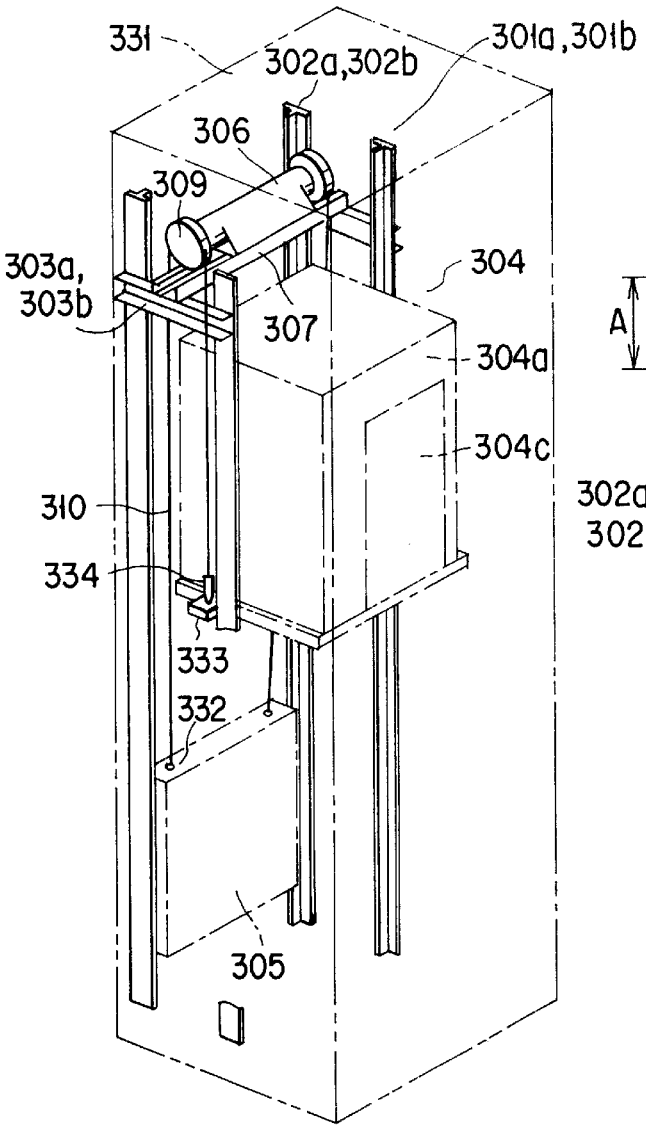
FIG. 31 is a view of the overall arrangement of an elevator according to the 13th embodiment of the present invention.

Referring to FIG. 31, when the driving motor of the driving device 306 starts rotating in accordance a command from a controller (not shown), the output shaft connected to the driving device 306 rotates, and the traction sheaves 309 attached to the two ends of the output shaft rotates to drive the ropes 310. Consequently, the car 304 ascends and descends along the car guide rails 301*a* and 301*b* while being balanced with the counterweight 305. Since the driving device 306 is firmly fixed by the support beams 303*a* and 303*b* and the channel bars 307 in the upper central portion of the four guide rails 301*a*, 301*b*, 302*a*, and 302*b*, the driving device 306 safely holds the car 304 and the counterweight 305.

In this embodiment, the total weight of the driving device 306 is supported by the four guide rails 301*a*, 301*b*, 302*a*, and 302*b*, and this load is transmitted to the lower surface of the elevator shaft. Therefore, no load acts on the elevator shaft structure.

Also, the driving device 306 is placed with a fixed positional relationship obtained by the support beams 303*a* and 303*b* and the channel bars 307 at the center of the guide rails 301*a*, 301*b*, 302*a*, and 302*b*. Accordingly, centering can be easily performed while the positional relationship between the car 304, the counterweight 305, and the driving device 306 is maintained. Furthermore, it is also possible to previously fix the driving device 306 to the guide rails 301*a*, 301*b*, 302*a*, and 302*b* on the ground and install the driving device 306 at the same time the guide rails 301*a*, 301*b*, 302*a*, and 302*b* are unloaded.

[14th Embodiment]

Figure 35:
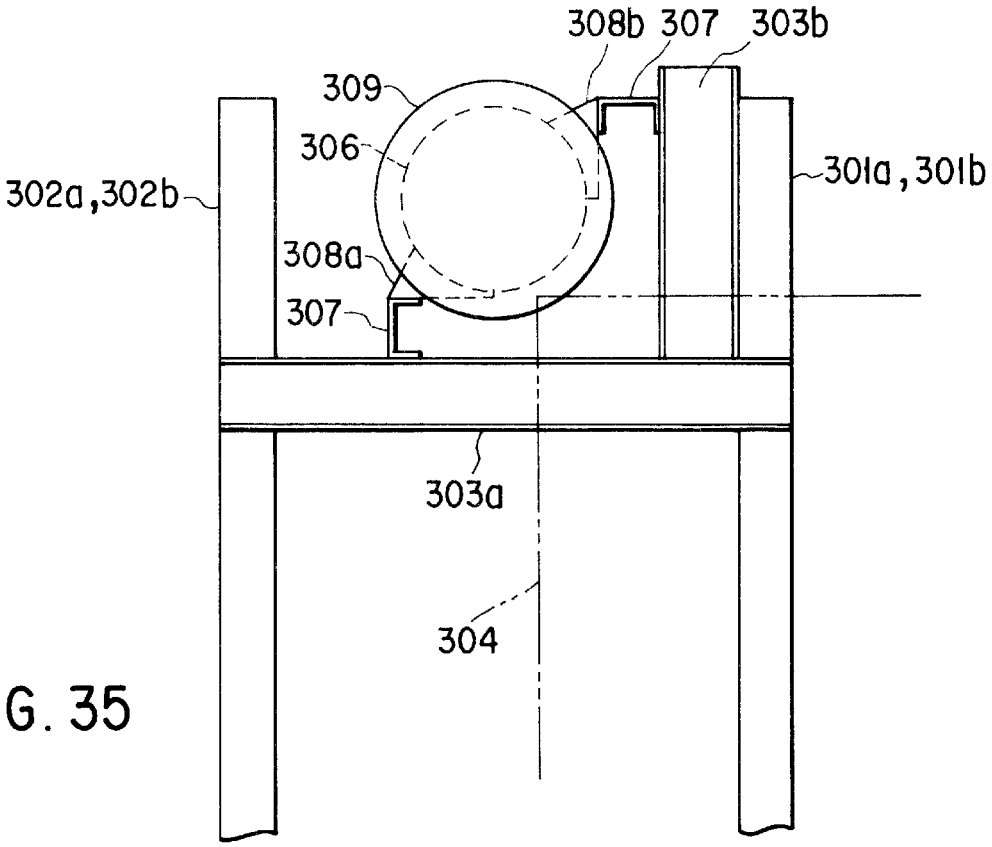
FIG. 35 is a side view showing a driving device of an elevator according to the 14th embodiment of the present invention.

FIG. 35 shows the 14th embodiment of the present invention.

Referring to FIG. 35, support beams 303*a* and 303*b* horizontally fixed between car guide rails 301*a* and 301*b* for guiding a car 304 and counterweight guide rails 302*a* and 302*b* for guiding a counterweight 305. At least one of the support beams 303*a* and 303*b* is positioned outside the projected plane immediately above the car 304. The guide rails 301*a*, 301*b*, 302*a*, and 302*b* and the support beams 303*a* and 303*b* are firmly fixed by bolts and nuts.

One channel bar 307 for supporting the lower portion of a driving device 306 is placed on the upper surface of the support beam 303*a*. Another channel bar 307 for supporting the side surface of the driving device 306 is placed on the side surface of the support beam 303*b* positioned close to the projected plane immediately above the car 304. A mounting leg 308*a* formed in the lower portion of the driving device 306 is placed on the upper surface of the former channel bar 307. A mounting leg 308*b* formed on the side surface of the elevator driving device 306 is attached to the side surface of the latter channel bar 307. These mounting legs 308*a* and 308*b* are fixed by bolts and nuts. Traction sheaves 309 for driving the elevator protrude from the two ends of the driving device 306 toward the guide rails 301*a*, 301*b*, 302*a*, and 302*b*. Ropes 310 for connecting the car 304 with the counterweight 305 are wound around these traction sheaves 309.

The operation of this embodiment will be described below.

Referring to FIG. 35, when the driving motor of the driving device 306 starts rotating in accordance a command from a controller (not shown), the driving shaft connected to the driving device 306 rotates, and the traction sheaves 309 attached to the two ends of the driving shaft rotates to drive the ropes 310. Consequently, the car 304 ascends and descends along the car guide rails 301*a* and 301*b* while being balanced with the counterweight 305. Since the driving device 306 is securely fixed by the support beams 303*a* and 303*b* and the channel bars 307 in the upper central portion of the four guide rails 301*a*, 301*b*,302*a*, and 302*b*, the driving device 306 safely holds the car 304 and the counterweight 305.

In this embodiment, the mounting leg 308*b* of the driving device 306 on the side of the car 304 is formed on the side surface of the driving device 306. Therefore, the height of ascent of the car 304 can be increased by the rise of position of the mounting leg 308*b*, compared to the case wherein the mounting legs 308*a* and 308*b* are formed in the lower portion of the driving device 306. This allows effective use of the elevator shaft space.

[15th Embodiment]

Figure 36:
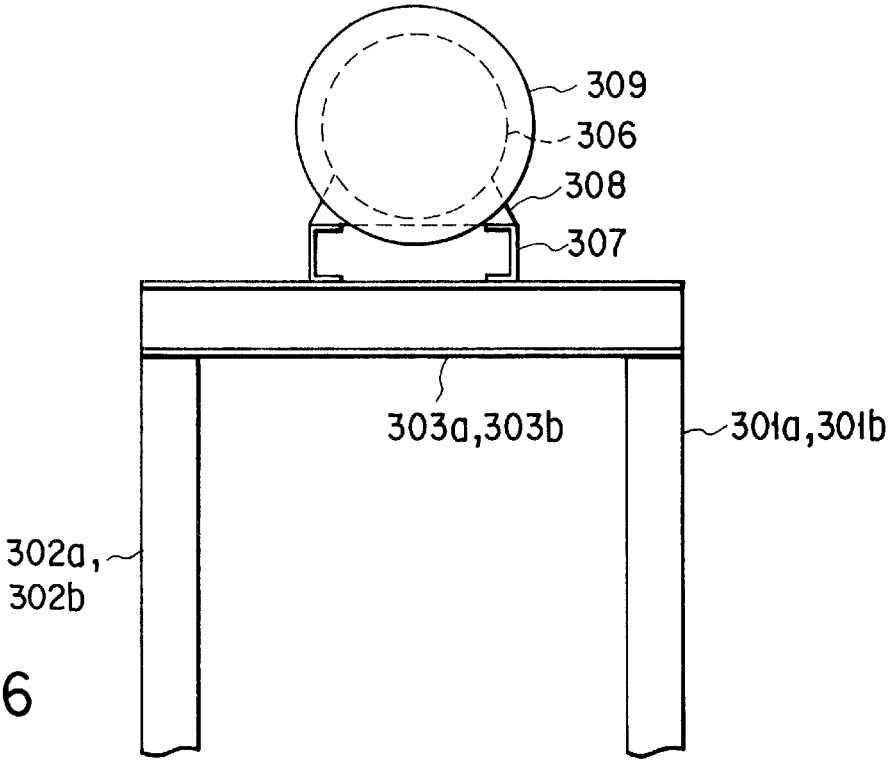
FIG. 36 is a side view showing a driving device of an elevator according to the 15th embodiment of the present invention.
Figure 37:
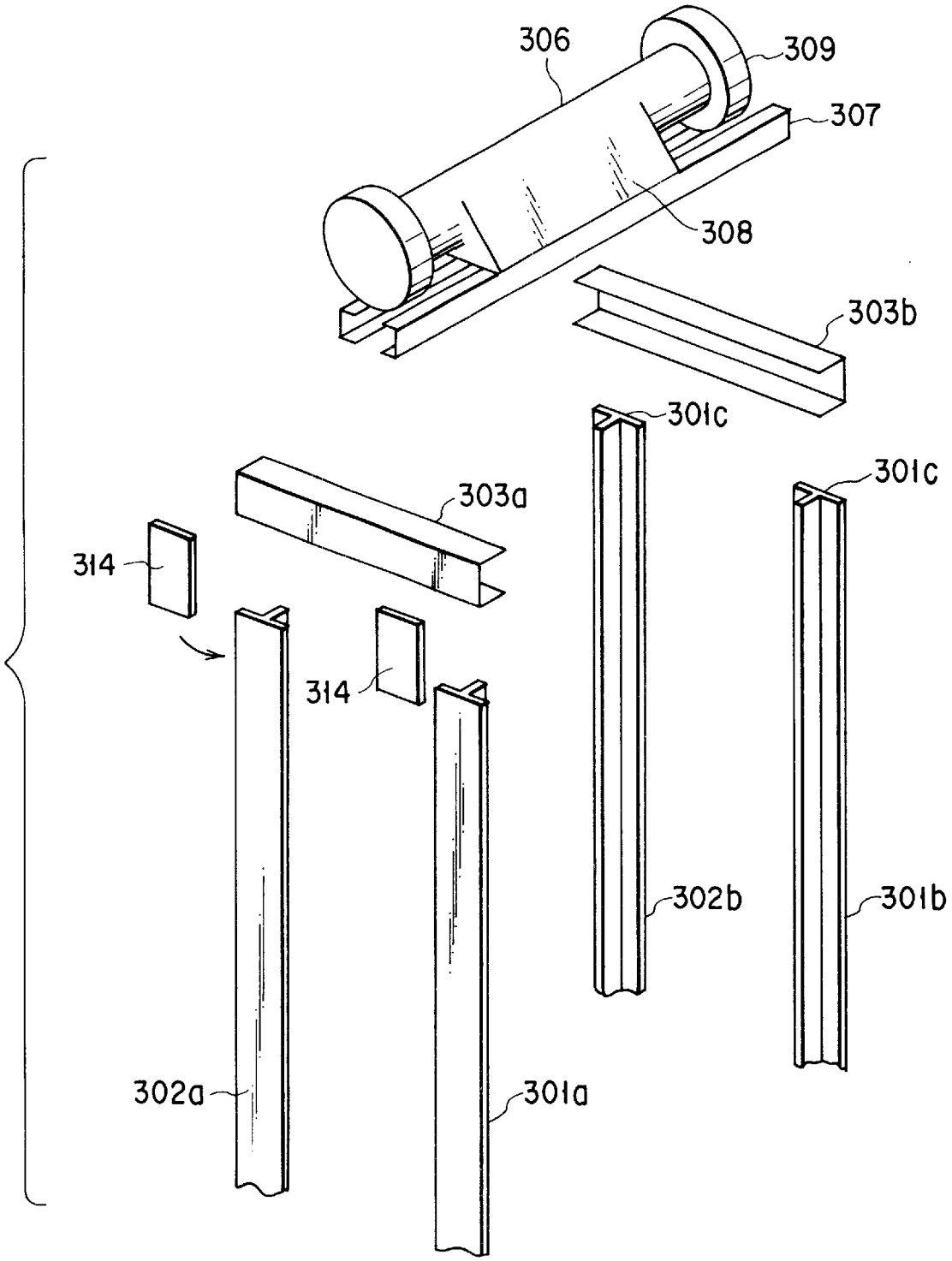
FIG. 37 is a view showing the arrangement of components of the driving device of the elevator according to the 15th embodiment of the present invention.

FIG. 36 shows the 15th embodiment of the present invention. FIG. 37 is a developed view of the components of the 15th embodiment.

Support beams 303*a* and 303*b* of a driving device 306 are placed on upper end faces 301*c* of guide rails 301*a*, 301*b*, 302*a*, and 302*b* for guiding a car 304 and a counterweight 305. Reinforcing plates 314 are fixed to the back surfaces of the guide Fails 301*a*, 301*b*, 302*a*, and 302*b* by bolts and nuts such that the end portions of these reinforcing plates support the left and right support beams 303*a* and 303*b*. Additionally, channel bars 307 are fixed to the support beams 303*a* and 303*b* by bolts and nuts. The driving device 306 is mounted on the upper surfaces of the channel bars 307.

The operation of this embodiment will be described below.

All loads acting on the driving device 306, i.e., the weights of the driving device 306, the car 304, and the counterweight 305 act vertically downward and are maintained by the upper end faces 301*c* of the guide rails 301*a*, 301*b*, 302*a*, and 302*b*. Ropes (not shown) are wound around traction sheaves 309 attached to the two ends of the driving device 306. Accordingly, the car 304 can be driven as in the 13th embodiment.

In this embodiment, all loads on the driving device 306 vertically act on the upper end faces 301*c* of the guide rails 301*a*, 301*b*, 302*a*, and 302*b*. This reduces the moment acting on the guide rails 301*a*, 301*b*, 302*a*, and 302*b* and hence reduces the stress generated on the end faces of the guide rails 301*a*, 301*b*, 302*a*, and 302*b*. Also, in the previous embodiment in which the support beams 303*a* and 303*b* are fixed to the side surfaces of the guide rails 301*a*, 301*b*, 302*a*, and 302*b*, a shear load acts on the fastening bolts. In this embodiment, however, only a compression load acts on the fastening bolts, so small bolts can be used. Furthermore, since the lengths of the four guide rails 301*a*, 301*b*, 302*a*, and 302*b* are controlled in the factory, the driving device 306 can be horizontally placed easily.

[16th Embodiment]

Figure 38:
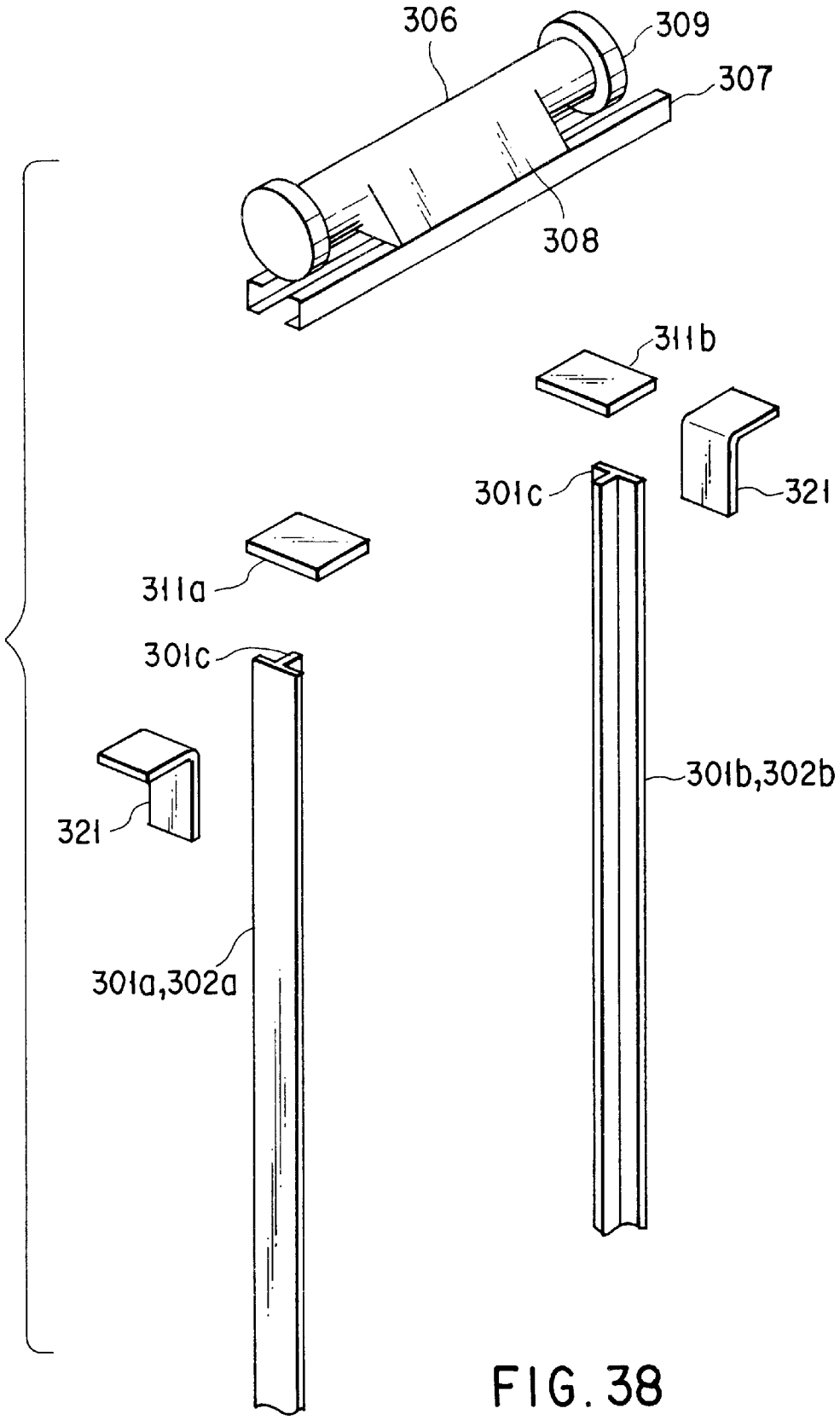
FIG. 38 is a view showing the arrangement of components of a driving device of an elevator according to the 16th embodiment of the present invention.

FIG. 38 shows the 16th embodiment of the present invention.

Fixing plates 311*a* and 311*b* are fixed to upper end faces 301*c* of guide rails 301*a* and 301*b* for a car 304 or guide rails 302*a* and 302*b* for a counterweight 305. These plates are fixed by welding or using receiving metal pieces 321 with an inverse L shape. Channel bars 307 for supporting a driving device 306 are placed on the upper surfaces of the fixing plates 311*a* and 311*b*.

In this embodiment, the load of the driving device 306 is supported by the two guide rails 301*a* and 301*b* or 302*a* and 302*b* for the car 304 or the counterweight 305, respectively.

This embodiment obviates the need to install the support beams 303*a* and 303*b* explained in the 13th to 15th embodiments and thereby further simplifies the structure. Consequently, it is possible to reduce the manufacturing cost and simplify the installation work. Additionally, the degree of freedom of the position of the driving device 306 can be increased by changing the size of the fixing plates 311*a* and 311*b*.

[17th Embodiment]

Figure 39:
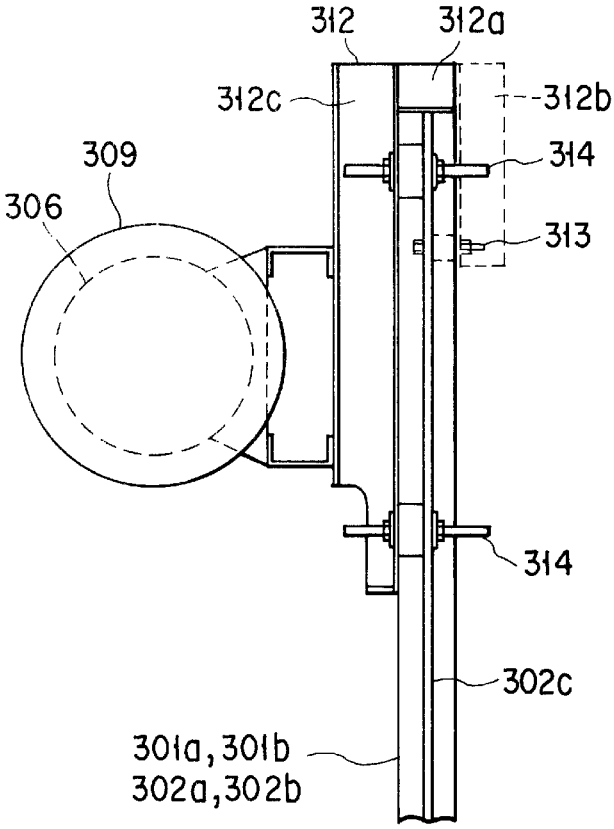
FIG. 39 is a side view showing a driving device of an elevator according to the 17th embodiment of the present invention.

FIG. 39 shows the 17th embodiment of the present invention.

L-shaped support members 312 are suspended from the upper end portions of guide rails 301*a* and 301*b* for a car 304 or guide rails 302*a* and 302*b* for a counterweight 305. The vertical load is supported by horizontal support members 312*a* in contact with the upper end portions of the guide rails 301*a* and 301*b* or 302*a* and 302*b*. Front support members 312*c* vertically extending parallel to tooth flanks 302*c* of the guide rails 301*a* and 301*b* or 302*a* and 302*b* are placed in front of the guide rails 301*a* and 301*b* or 302*a* and 302*b*. The upper and lower end portions of these front support members 312*c* are fixed to the tooth flanks of the guide rails 301*a* and 301*b* or 302*a* and 302*b* by through bolts 314. A driving device 306 for driving the car 304 via ropes (not shown) wound around the car 304 and the counterweight 305 is fixed to the vertical surfaces of the front support members 312*c* of the guide rails 301*a* and 301*b* or 302*a* and 302*b* by using fastening members such as bolts or by welding. As another fixing method, U-shaped support members 312 can also be suspended. If this is the case, in addition to the horizontal support members 312*a*, back support members 312*b* can be fixed to the tooth flanks 302*c* of the guide rails 301*a* and 301*b* or 302*a* and 302*b* at the back of the guide rails 301*a* and 301*b* or 302*a* or 302*b*.

The operation of this embodiment will be described below by taking the L-shaped support members 312 as an example.

The horizontal support members 312*a* formed at the upper ends of the front support members 312*c* transmit the loads of the driving device 306, the car 304, and the counterweight 305 to the guide rails 301*a* and 301*b* or 302*a* and 302*b*. The front support members 312*c* of the guide rails 301*a* and 301*b* or 302*a* and 302*b* receive the moment from the driving device 306 and thereby prevent the support members 312 from tilting. The front support members 312*c* also support the driving device 306. Even when the U-shaped support members 312 are used, the operation is the same except that the back support members also receive the moment from the driving device 306.

In this embodiment, the driving device 306 can be installed in the elevator shaft only by suspending the driving device 306 from the guide rails 301*a* and 301*b* or 302*a* and 302*b*. This simplifies the installation work. At the same time, the driving device 306 can be fixed in the elevator shaft by the fixed support members 312, 312*a*, 312*b*, and 312*c* independently of the mutual installation dimensions of the guide rails 301*a* and 301*b* or 302*a* and 302*b*.

[18th Embodiment]

Figure 40:
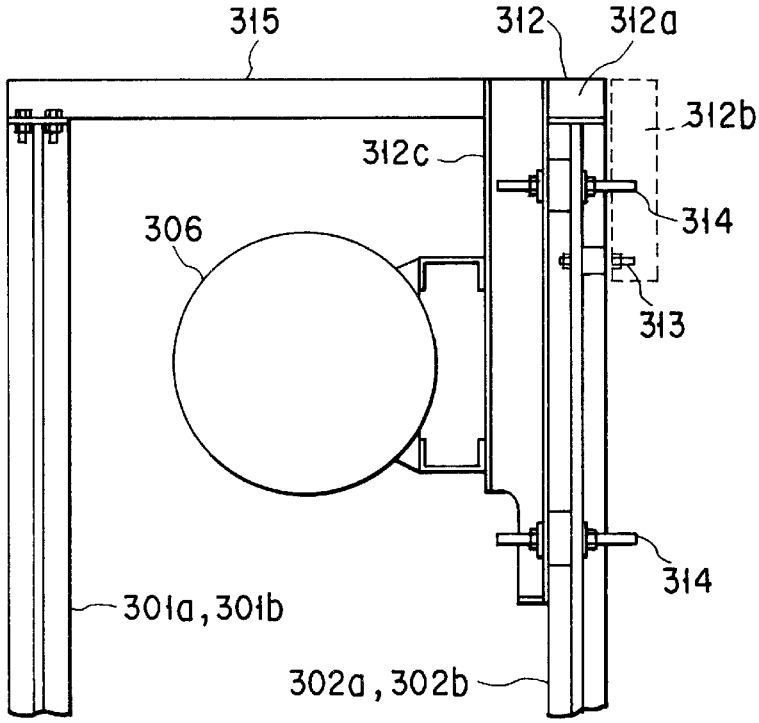
FIG. 40 is a side view showing a driving device of an elevator according to the 18th embodiment of the present invention.

FIG. 40 shows the 18th embodiment of the present invention.

L-shaped support members 312 are suspended from the upper end portions of guide rails 301*a* and 301*b* for a car 304 or guide rails 302*a* and 302*b* for a counterweight 305. Horizontal members 315 are fixed to the upper surfaces of the support members 312, and the other ends are fixed to the upper portions of the other guide rails 301*a* and 301*b* or 302*a* and 302*b*.

This embodiment has a function of transmitting the loads of the car 304, the counterweight 305, and the like acting on a driving device 306 to the other pair of guide rails. As explained in the 17th embodiment, the same function can be achieved even when U-shaped support members 312 are used.

In this embodiment, even when the weight of the counterweight 305 or the like increases, a bending load produced by the load moment can be transmitted to the other pair of guide rails. Consequently, the strength is approximately doubled, so the driving device can be firmly fixed. Also, even when an earthquake or the like occurs, the four guide rails 301*a*, 301*b*, 302*a*, and 302*b* disperse the load, and this improves the safety.

[19th Embodiment]

Figure 41:
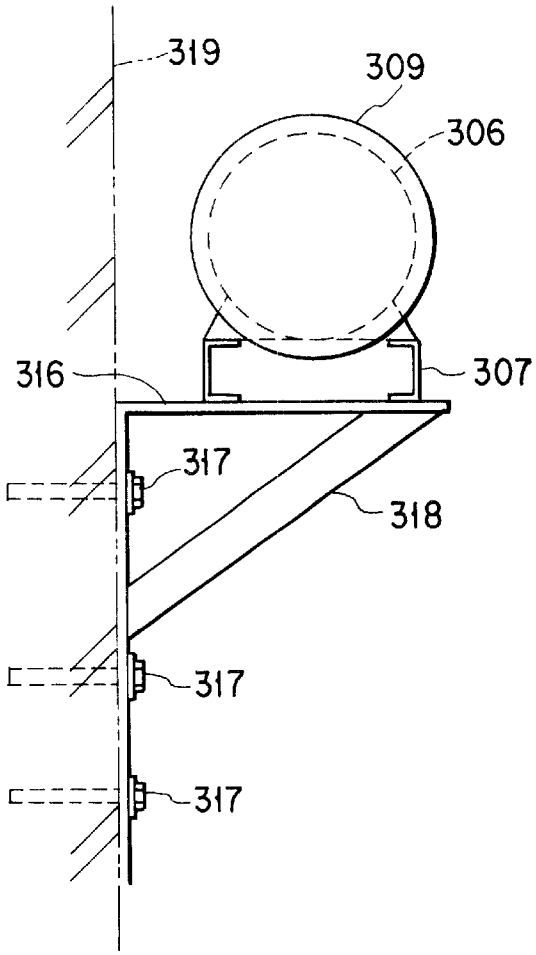
FIG. 41 is a side view showing a driving device of an elevator according to the 19th embodiment of the present invention.

FIG. 41 shows the 19th embodiment of the present invention.

An L-shaped support member 316 is fixed to an upper wall 319 of an elevator shaft by anchor bolts 317. Channel bars 307 for supporting a driving device 306 are placed on the upper horizontal surface of the support member 316. The driving device 306 is fixed on the channel bars 307. A reinforcing member 318 is attached to the support member 316.

In this embodiment, the load acting on the driving device 306 is entirely supported by the elevator shaft wall 319.

In this embodiment, when the elevator shaft wall 319 is made of reinforced concrete, the driving device 306 can be installed in any arbitrary position of the elevator shaft wall 319. Also, even before guide rails 301*a*, 301*b*, 302*a*, and 302*b* are installed, the driving device 306 can be installed if there is a gondola or a scaffold. Accordingly, the driving device 306 can be installed at any arbitrary point during the installation of the elevator.

[20th Embodiment]

Figure 42:
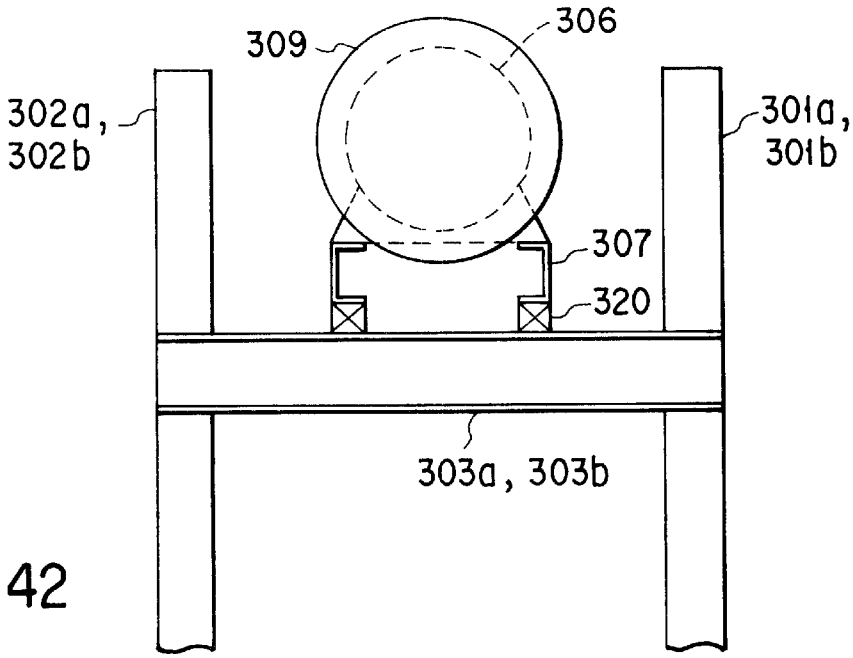
FIG. 42 is a side view showing a driving device of an elevator according to the 20th embodiment of the present invention.
Figure 43:
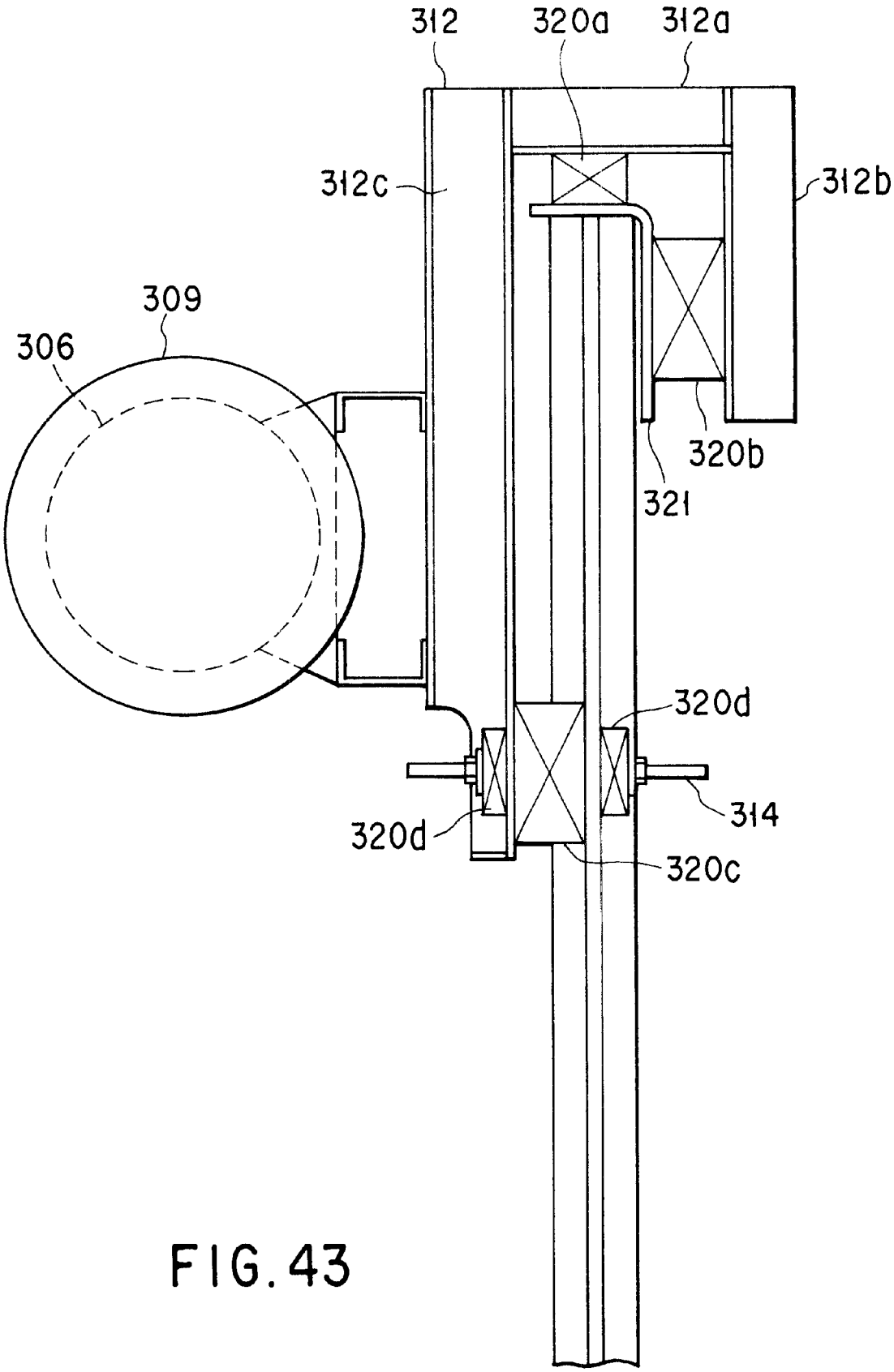
FIG. 43 is a side view showing the driving device of the elevator according to the 20th embodiment of the present invention.
Figure 44:
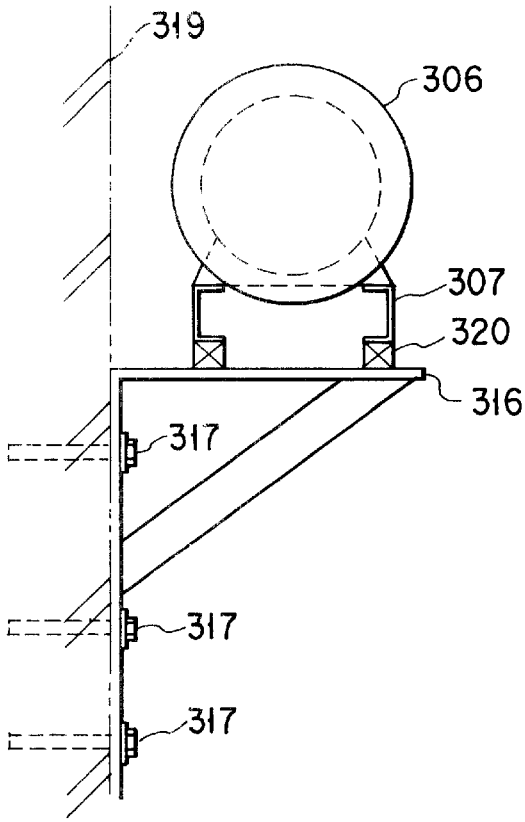
FIG. 44 is a side view showing the driving device of the elevator according to the 20th embodiment of the present invention.

FIGS. 42 to 44 show the 20th embodiment of the present invention.

FIGS. 42, 43, and 44 show modifications of the 13th, 17th, and 19th embodiments, respectively. Referring to FIGS. 42 and 44, elastic members 320 such as elastic rubber are interposed between channel bars 307 for supporting a driving device 306 and support beams 303*a* and 303*b* or a support member 316. FIG. 42 shows a modification in which the driving device 306 is mounted between guide rails 301*a*, 301*b*, 302*a*, and 302*b*. FIG. 44 shows a modification in which the driving device 306 is attached to an elevator shaft wall 319. Referring to FIG. 43, an elastic member 320*a* is interposed between a horizontal support member 312*a* and a receiving metal piece 321 on the guide rail 301*a* (301*b*) or 302*a* (302*b*). An elastic member 320*b* is interposed between a back support member 312*b* and the receiving metal piece 321. An elastic member 320*c* is interposed between a front support member 312*c* and the tooth flank of the guide rail 301*a* (301*b*) or 302*a* (302*b*). A support member 321 is fixed to the guide rail 301*a* (301*b*) or 302*a* (302*b*) by a through bolt 314 via elastic members 320*d*. The driving device 306 is fixed to the front support member 312*c* by bolts or the like.

In this embodiment, the driving device 306 is supported while vibrations are insulated between the guide rails 301*a*, 301*b*, 302*a*, and 302*b* or the elevator shaft wall 319. Therefore, vibrations generated by the driving device while the elevator is running are not transmitted to the guide rails 301*a*, 301*b*, 302*a*, and 302*b* or the elevator shaft wall 319. Consequently, even when the driving device 306 is installed inside the elevator shaft, the elevator can be used without generating vibrations or noise.

[21st Embodiment]

Figure 45:
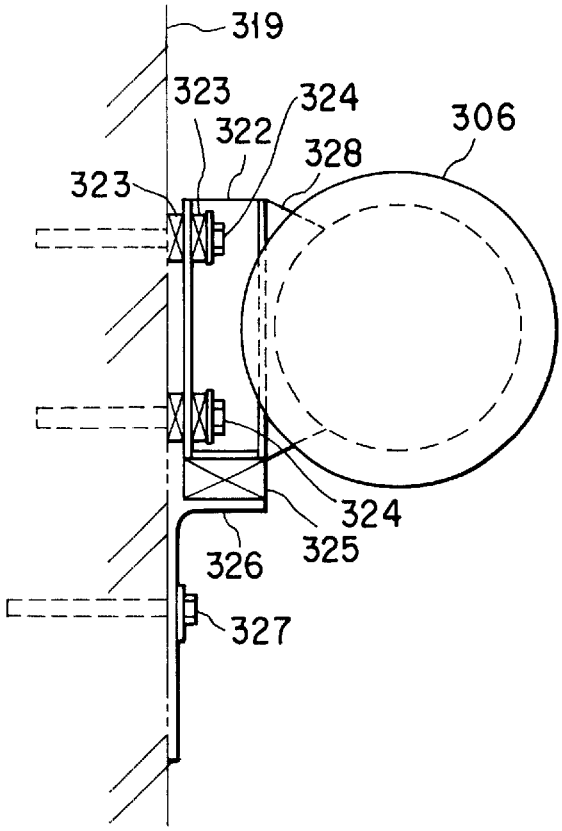
FIG. 45 is a side view showing a driving device of an elevator according to the 21st embodiment of the present invention.

FIG. 45 shows the 21st embodiment of the present invention.

A pedestal 322 directly attached to a mounting leg 328 of a driving device 306 is sandwiched between front and rear elastic members 323 and fixed to an elevator shaft wall 319. The lower portion of the pedestal 322 is supported by a receiving metal piece 326 via an elastic member 325. The receiving metal piece 326 is fixed to the elevator shaft wall 319 by anchor bolts 327.

In this embodiment, the driving device 306 is directly attached to the elevator shaft wall 319, and the load is supported by the receiving metal piece 326. Additionally, the whole driving device 306 is elastically supported by the elevator shaft wall 319.

Since the driving device 306 is directly attached to the elevator shaft, the area occupied by the driving device 306 is minimized. The vertical load is received by the receiving metal piece 326 and transmitted to the elevator shaft. However, vibrations generated while the elevator is in operation are insulated by the elastic members 323 and 325. This allows silent operation with no noise.

[22nd Embodiment]

Figure 46:
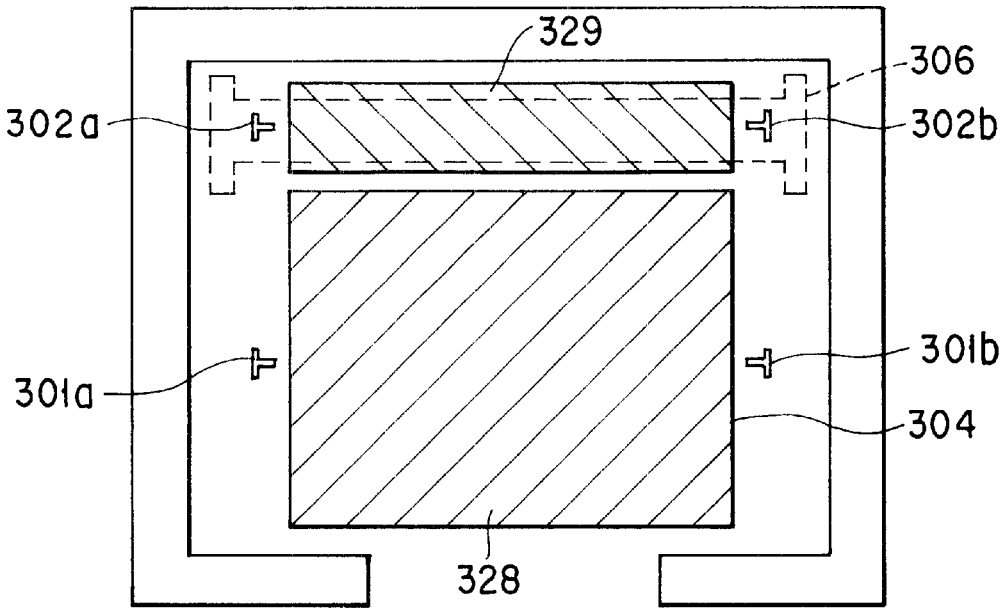
FIG. 46 is a side view showing a driving device of an elevator according to the 22nd embodiment of the present invention.
Figure 47:
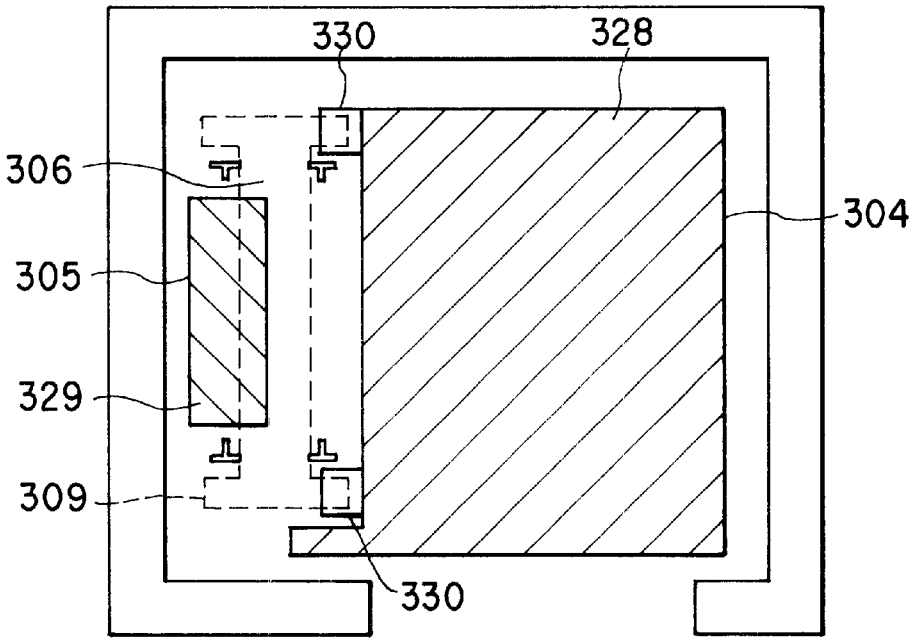
FIG. 47 is a side view showing the driving device of the elevator according to the 22nd embodiment of the present invention.

FIGS. 46 and 47 show the 22nd embodiment of the present invention.

Referring to FIG. 46, a driving device 306 is placed in the rear (the rear of a car when viewed from its doorway) at the top of an elevator shaft. The driving device 306 is so positioned as not. to interfere with a horizontally projected plane 328 of a car 304. The positional relationship of a counterweight 305 with the horizontally projected plane 328 is not particularly specified.

Referring to FIG. 47, the driving device. 306 is placed on the side surface (the side surface of the car when viewed from the doorway) at the top of an elevator shaft. The driving device 306 is so positioned as not to interfere with the horizontally projected plane 328 of the car 304. The positional relationship of the counterweight 305 with the horizontally projected plane 328 is not particularly specified. The car 304 and the counterweight 305 are connected by traction sheaves 309 attached to the two ends of the driving device 306 via ropes 310. The car 304 ascends and descends in the elevator shaft by the operation of the driving device 306.

The ropes 310 are fixed by hitches 330 in the lower portion of the car 304 and so positioned as not to interfere with the outer surfaces of a car room for accommodating passengers.

In this embodiment, the car 304 does not contact the driving device 306 even when the car 304 ascends because the driving device 306 is positioned outside the projected plane of the car 304. Accordingly, the total height of the elevator shaft can be minimized only by ensuring a dimension by which the upper portion of the car does not interfere with the top of the elevator shaft, without forming any particular installation space for the driving device 306 at the top of the elevator shaft.

In the inventions according to the 13th to 22nd embodiments described above, the driving device can be simply installed while a fixed relationship with the guide rails is maintained. This makes a dedicated machine house unnecessary.

Also, since the driving device can be simply installed on the elevator shaft wall, no dedicated machine house is necessary.

Additionally, vibrations can be prevented from being transmitted from the driving device to the guides rails or the elevator shaft wall. This prevents vibrations and noise while the elevator is in operation.

Furthermore, the driving device can be installed in the elevator shaft without forming any specific space at the top of the elevator shaft. So, the elevator can be installed without separately constructing any specific machine house. Consequently, it is possible to reduce the construction cost, effectively use the space, and construct the elevator within short time periods.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An elevator comprising:

a car moving up and down along car guide rails;

a counterweight moving up and down along counterweight guide rails, said counterweight being installed at the back when viewed from a doorway of said car;

ropes for suspending said car and said counterweight, hitches of said ropes being formed below a ceiling surface of said car;

a driving device contained in an elevator shaft and installed at a top of said elevator shaft above said counterweight along a vertical extension line of said counterweight; and at least one traction sheave engaging with said ropes and rotated by said driving device, said at least one traction sheave being placed close to a first wall surface of an said driving device comprises speed reducers fixed to elevator shaft wall, which is adjacent to a second wall surface facing said counterweight and outside a horizontally projected plane of said car, and said at least one traction sheave being placed in a space between said first wall surface of the elevator shaft wall and a side surface of the car that is opposed to said first wall surface, wherein an outside diameter of a frame of said driving device is smaller than a diameter of said at least one traction sheave.

2. An elevator according to claim 1, wherein hitches of said ropes are formed in a lower portion of said car.

3. An elevator according to claim 1, wherein said driving device comprises a plurality of traction sheaves.

4. An elevator according to claim 3, wherein positions where said car is suspended by said ropes suspended from said traction sheaves are substantially symmetrical about a center of gravity of said car.

5. An elevator according to claim 4, wherein a position where said car is suspended by said rope is moved by a deflection sheave placed in an upper portion of said elevator shaft.

6. An elevator according to claim 1, wherein said driving device is positioned outside said horizontally projected plane of said car.

7. An elevator according to claim 1, wherein said driving device uses no speed reducer.

8. An elevator according to claim 1, wherein said driving device comprises a speed reducer.

9. An elevator comprising:

a car moving up and down along car guide rails;

a counterweight moving up and down along counterweight guide rails, said counterweight being installed at the back when viewed from a doorway of said car;

ropes for suspending said car and said counterweight, hitches of said ropes being formed below a ceiling surface of said car;

a driving device contained in an elevator shaft and comprising traction sheaves engaging with said ropes, said driving device being installed at a top of said elevator shaft above said counterweight along a vertical extension line of said counterweight, an outside diameter of a frame of said driving device being smaller than a diameter of said traction sheaves, said traction sheaves being attached to two ends of an output shaft of said driving device and being placed close to first wall surfaces of an elevator shaft wall, which are adjacent to a second wall surface facing said counterweight and outside a horizontally projected plane of said car, and said traction sheaves being placed in a space between said first wall surfaces of the elevator shaft wall and side surfaces of the car that is opposed to said first wall surfaces.

10. An elevator according to claim 9, wherein at least a portion of an output shaft of said driving device has a joint.

11. An elevator according to claim 9, wherein an output shaft of said driving device has a plurality of joints, which are connected by a joint shaft.

12. An elevator according to claim 9, wherein said traction sheaves are detachably attached to an output shaft via a fastening member.

13. An elevator according to claim 9, wherein said driving device is a gearless driving device using no speed reducer.

14. An elevator according to claim 9, wherein said driving device comprises a hollow speed reducer connected to said output shaft and a driving motor for applying a driving force to said speed reducer.

15. An elevator according to claim 9, wherein said driving device comprises speed reducers fixed to a frame of a driving motor, and traction sheaves fixed to output shafts of said speed reducers.

16. An elevator according to claim 9, wherein a support leg of said driving device is offset from a plane connecting vertical central lines of said traction sheaves in a direction away from said car.

17. An elevator according to claim 9, wherein said driving device comprises a gear attached to said output shaft, a speed reducer having a pinion meshing with said gear, and a driving motor for applying a driving force to said speed reducer.

18. An elevator according to claim 9, wherein said driving device comprises speed reducers having output shafts fixed to said traction sheaves, and a driving motor connected to said speed reducers via transmitting means.

* * * * *